US012110748B1

(12) United States Patent
Barker

(10) Patent No.: US 12,110,748 B1
(45) Date of Patent: Oct. 8, 2024

(54) TURBULENCE REDUCING DOWNHOLE APPARATUS

(71) Applicant: DRILLING TOOLS INTERNATIONAL, INC., Houston, TX (US)

(72) Inventor: David Barker, Houston, TX (US)

(73) Assignee: DRILLING TOOLS INTERNATIONAL, INC., Houston, TX (US)

( * ) Notice: Subject to any disclaimer, the term of this patent is extended or adjusted under 35 U.S.C. 154(b) by 0 days.

(21) Appl. No.: 18/626,301

(22) Filed: Apr. 3, 2024

Related U.S. Application Data

(60) Provisional application No. 63/457,111, filed on Apr. 4, 2023.

(51) Int. Cl.
*E21B 21/10* (2006.01)

(52) U.S. Cl.
CPC ..... *E21B 21/103* (2013.01)

(58) Field of Classification Search
CPC ..... E21B 21/10; E21B 21/103; E21B 34/08
See application file for complete search history.

(56) References Cited

U.S. PATENT DOCUMENTS

| | | | | |
|---|---|---|---|---|
| 2,750,958 | A * | 6/1956 | Baker | F16K 15/063 137/543.13 |
| 2,771,091 | A * | 11/1956 | Baker | E21B 21/10 137/454.2 |
| 2,841,171 | A * | 7/1958 | Baker | E21B 21/10 137/493 |
| 10,309,193 | B2 | 6/2019 | Gordon et al. | |
| 2014/0144526 | A1 | 5/2014 | Russell | |
| 2018/0347301 | A1 * | 12/2018 | Hilliard | E21B 21/10 |

* cited by examiner

*Primary Examiner* — Matthew R Buck
(74) *Attorney, Agent, or Firm* — Halit N. Yakupoglu

(57) ABSTRACT

A downhole valve apparatus, for controlling fluid flow in drilling operations, includes a tubular housing and a float valve movably held within a valve bore of the tubular housing and partially within a stress relief bore. The float valve is axially movable relative to the tubular housing while in a sealing relationship with the valve bore between a first configuration and a second configuration of the downhole valve apparatus. A valve member of the float valve allows a downward flow of a drilling fluid of a first pressure to flow through the float valve in the first configuration, and the valve member blocks an upward flow of any fluid of a second pressure from the well through the float valve in the second configuration.

20 Claims, 15 Drawing Sheets

| BHA Connection Type | Tool Size Range | Most Common Tool Size (D SU) | L I | D IP | L C | D S | L S | L VB | D VB |
|---|---|---|---|---|---|---|---|---|---|
| 3 1/2 Reg | 4 3/8 - 4 1/2 | 4 1/2 | 3.625 - 3.750 | 1.969 - 2.031 | .188 - .438 | 2.719 - 2.735 | .903 - .965 | 5.910 - 5.970 | 2.438 - 2.452 |
| 4 1/2 Reg | 5 1/2 - 6 | 5 1/2 | 4.125 - 4.250 | 2.594 - 2.656 | .188 - .438 | 3.719 - 3.735 | 1.675 - 1.735 | 6.950 - 7.010 | 3.500 - 3.516 |
| 5 1/2 FH | 6 7/8 - 8 | 7 | 4.875 - 5.000 | 3.469 - 3.531 | .188 - .438 | 5.109 - 5.125 | 2.525 - 2.585 | 9.540 - 9.600 | 4.813 - 4.829 |
| 5 1/2 IF | 7 1/2 - 9 | 8 | 4.875 - 5.000 | 3.719 - 3.781 | .188 - .438 | 5.688 - 5.704 | 2.755 - 2.815 | 9.310 - 9.370 | 4.813 - 4.829 |
| 5 1/2 Reg | 6 5/8 - 7 1/2 | 7 | 4.625 - 4.750 | 2.969 - 3.031 | .188 - .438 | 4.500 - 4.516 | 2.205 - 2.265 | 7.860 - 7.920 | 3.906 - 3.922 |
| 6 5/8 Reg | 7 1/2 - 8 1/4 | 8 | 4.875 - 5.000 | 3.344 - 3.406 | .188 - .438 | 5.281 - 5.297 | 2.605 - 2.665 | 9.460 - 9.520 | 4.813 - 4.829 |
| 7 5/8 Reg | 8 5/8 - 9 1/2 | 9 1/2 | 5.125 - 5.250 | 3.969 - 4.031 | .188 - .438 | 5.859 - 5.875 | 2.895 - 2.955 | 9.170 - 9.230 | 4.813 - 4.829 |
| 8 5/8 Reg | 9 5/8 - 10 1/2 | 9 5/8 | 5.250 - 5.375 | 4.344 - 4.406 | .188 - .438 | 6.781 - 6.797 | 2.850 - 2.880 | 9.250 - 6.310 | 4.813 - 4.829 |
| NC38 | 4 3/4 - 5 1/4 | 5 | 3.875 - 4.000 | 2.469 - 2.531 | .188 - .438 | 3.468 - 3.484 | 3.465 - 3.525 | 5.050 - 5.110 | 3.156 - 3.172 |
| NC44 | 5 3/4 - 6 1/4 | 6 | 4.375 - 4.500 | 2.844 - 3.006 | .188 - .438 | 4.000 - 4.016 | 2.135 - 2.195 | 7.930 - 7.990 | 3.906 - 3.922 |
| NC46 | 6 - 6 7/8 | 6 1/2 | 4.375 - 4.500 | 2.969 - 3.031 | .188 - .438 | 4.203 - 4.249 | 2.285 - 2.345 | 7.780 - 7.840 | 3.906 - 3.922 |
| NC50 | 6 1/4 - 7 1/4 | 6 3/4 | 4.375 - 4.500 | 3.219 - 3.281 | .188 - .438 | 4.625 - 4.641 | 2.235 - 2.295 | 7.830 - 7.890 | 3.906 - 3.922 |
| NC56 | 7 1/4 - 8 | 8 | 4.875 - 5.000 | 3.219 - 3.281 | .188 - .438 | 4.797 - 4.813 | 2.255 - 2.315 | 7.810 - 7.870 | 3.906 - 3.922 |
| NC61 | 8 1/4 - 9 | 9 | 5.375 - 5.500 | 3.219 - 3.281 | .188 - .438 | 5.234 - 5.250 | 2.875 - 2.935 | 9.190 - 9.250 | 4.813 - 4.829 |

FIG. 13A

| BHA Connection Type | Tool Size Range | Most Common Tool Size (D SU) | D BO | D FT | L FC | D FB | L V | D VC | L O |
|---|---|---|---|---|---|---|---|---|---|
| 3 1/2 Reg | 4 3/8 - 4 1/2 | 4 1/2 | 1.250 - 1.750 | 1.759 - 1.785 | 3.545 - 3.575 | 1.302 - 1.328 | 6.470 - 6.530 | 1.759 - 1.785 | .845 - .905 |
| 4 1/2 Reg | 5 1/2 - 6 | 5 1/2 | 1.969 - 2.750 | 2.609 - 2.641 | 4.341 - 4.401 | 2.044 - 2.076 | 8.283 - 8.343 | 2.609 - 2.641 | .720 - .780 |
| 5 1/2 FH | 6 7/8 - 8 | 7 | 2.875 - 3.625 | 3.681 - 3.719 | 6.785 - 6.885 | 2.924 - 2.956 | 11.700 - 11.800 | 3.681 - 3.719 | .970 - 1.030 |
| 5 1/2 IF | 7 1/2 - 9 | 8 | 2.875 - 3.625 | 3.681 - 3.719 | 6.785 - 6.885 | 2.924 - 2.956 | 11.700 - 11.800 | 3.681 - 3.719 | .970 - 1.030 |
| 5 1/2 Reg | 6 5/8 - 7 1/2 | 7 | 2.250 - 3.000 | 2.984 - 3.016 | 3.930 - 3.990 | 2.299 - 2.331 | 9.720 - 9.780 | 2.984 - 3.016 | .720 - .780 |
| 6 5/8 Reg | 7 1/2 - 8 1/4 | 8 | 2.875 - 3.625 | 3.681 - 3.719 | 6.785 - 6.885 | 2.924 - 2.956 | 11.700 - 11.800 | 3.681 - 3.719 | .970 - 1.030 |
| 7 5/8 Reg | 8 5/8 - 9 1/2 | 9 1/2 | 2.875 - 3.625 | 3.681 - 3.719 | 6.785 - 6.885 | 2.924 - 2.956 | 11.700 - 11.800 | 3.681 - 3.719 | .970 - 1.030 |
| 8 5/8 Reg | 9 5/8 - 10 1/2 | 9 5/8 | 2.875 - 3.625 | 3.681 - 3.719 | 6.785 - 6.885 | 2.924 - 2.956 | 11.700 - 11.800 | 3.681 - 3.719 | .970 - 1.030 |
| NC38 | 4 3/4 - 5 1/4 | 5 | 1.625 - 2.688 | 2.109 - 2.141 | 6.261 - 6.335 | 1.678 - 1.704 | 9.963 - 10.037 | 2.109 - 2.141 | .845 - .905 |
| NC44 | 5 3/4 - 6 1/4 | 6 | 2.250 - 3.000 | 2.984 - 3.016 | 3.930 - 3.990 | 2.299 - 2.331 | 9.720 - 9.780 | 2.984 - 3.016 | .720 - .780 |
| NC46 | 6 - 6 7/8 | 6 1/2 | 2.250 - 3.000 | 2.984 - 3.016 | 3.930 - 3.990 | 2.299 - 2.331 | 9.720 - 9.780 | 2.984 - 3.016 | .720 - .780 |
| NC50 | 6 1/4 - 7 1/4 | 6 3/4 | 2.250 - 3.000 | 2.984 - 3.016 | 3.930 - 3.990 | 2.299 - 2.331 | 9.720 - 9.780 | 2.984 - 3.016 | .720 - .780 |
| NC56 | 7 1/4 - 8 | 8 | 2.250 - 3.000 | 2.984 - 3.016 | 3.930 - 3.990 | 2.299 - 2.331 | 9.720 - 9.780 | 2.984 - 3.016 | .720 - .780 |
| NC61 | 8 1/4 - 9 | 9 | 2.875 - 3.625 | 3.681 - 3.719 | 6.785 - 6.885 | 2.924 - 2.956 | 11.700 - 11.800 | 3.681 - 3.719 | .970 - 1.030 |

FIG. 13B

TURBULENCE REDUCING DOWNHOLE APPARATUS

CROSS REFERENCE TO RELATED APPLICATION

This application relates to and claims priority from U.S. provisional patent application No. 63/457,111 filed on Apr. 4, 2023, which is expressly incorporated herein by reference in its entirety.

BACKGROUND

Field of the Invention

The present invention relates to downhole apparatus and methods in drilling systems, more particularly, to downhole apparatus including downhole valves used in drilling operations in wells for controlling fluid flow.

Description of the Related Art

Downhole valves have always been essential components of drill strings used in downhole drilling operations for recovering hydrocarbons for many decades.

Generally, downhole valves allow one way fluid flow, such as drilling fluid or mud, in one direction and stop the fluid flow, such as a reverse flow from the wellbore, in other direction.

Downhole valves can be used for a variety of conditions in hydrocarbon wellbores to maintain operational goals and safety requirements.

For example, downhole valves, such as float valves, can be the first line of defense in preventing wellbore fluid influx from rising to the surface through the drill string, which can cause a life-threatening loss of control of a well. In another example, downhole valves can minimize the amount of drilling mud spilled on a rig floor when tripping into a well.

SUMMARY

An aspect of the present invention includes a downhole valve apparatus for controlling fluid flow in a string of tubing in drilling operations. The downhole valve apparatus includes: a tubular housing for connection within a bottom hole assembly in the string of tubing, when connected to an upper tubular housing of the string of tubing a top female end of the tubular housing receives a male end of the upper tubular housing in a joint region; a valve bore of a first diameter in the tubular housing that communicates with a stress relief bore of a second diameter of the tubular housing, the second diameter being greater than the first diameter; a valve housed within the valve bore and partially within the stress relief bore being axially movable relative to the tubular housing while in a sealing relationship with the valve bore between a first configuration and a second configuration of the downhole valve apparatus; a valve member of the valve allows a downward flow of a first fluid having a first pressure delivered to the stress relief bore to flow through the valve in the first configuration, and the valve member blocks an upward flow of a second fluid of a second pressure toward the stress relief bore through the valve in the second configuration; and the valve is adapted that in the second configuration the upward flow of the second fluid axially moves the valve upward within both the stress relief bore and the valve bore of the tubular housing, and in the first configuration the downward flow of the first fluid to the stress relief bore axially moves the valve downward within both the stress relief bore and the valve bore, the at least one radial seal on the valve seals an annular space between the valve and the valve bore so that no second fluid flows upwardly through the annular space in the second configuration.

Another aspect of the present invention includes a method of controlling fluid flow in a string of tubing in drilling operations. The method includes: providing a downhole valve apparatus having a tubular housing for connection within a bottom hole assembly in the string of tubing, when connected to an upper tubular housing of the string of tubing a top female end of the tubular housing receives a male end of the upper tubular housing in a joint region, the tubular housing including a valve bore of a first diameter communicating with a stress relief bore of a second diameter which is greater than the first diameter, the stress relief bore axially extending between a top opening of the valve bore of the tubular housing and a lower end of the joint region; a float valve, including a valve member, is located within the valve bore of the tubular housing and partially within the stress relief bore, the float valve being axially movable relative to the tubular housing between a first configuration and a second configuration of the downhole valve apparatus; sealing an annular space between the float valve and the valve bore with at least one radial seal on the float valve; deploying the string of tubing including the downhole valve apparatus in a wellbore for a drilling operation and commencing the drilling operation; exposing the downhole valve apparatus to a first fluid, wherein the valve member allows a downward flow of the first fluid delivered to the stress relief bore, to flow through the float valve in the first configuration, wherein the downward flow of the first fluid to the stress relief bore axially moves the float valve downward within both the stress relief bore and the valve bore; and exposing the downhole valve apparatus to a second fluid, wherein the valve member blocks an upward flow of the second fluid toward the stress relief bore through the float valve in the second configuration and the upward flow of the second fluid axially moves the float valve upward within both the stress relief bore and the valve bore of the tubular housing; sealing the annular space between the float valve and the valve bore prevents the second fluid from flowing into the stress relief bore through the annular space between the valve bore and the float valve in the second configuration.

BRIEF DESCRIPTION OF THE DRAWINGS

FIGS. 13A and 13B illustrate tables of various exemplary dimensions.

DETAILED DESCRIPTION

Figure 1A:
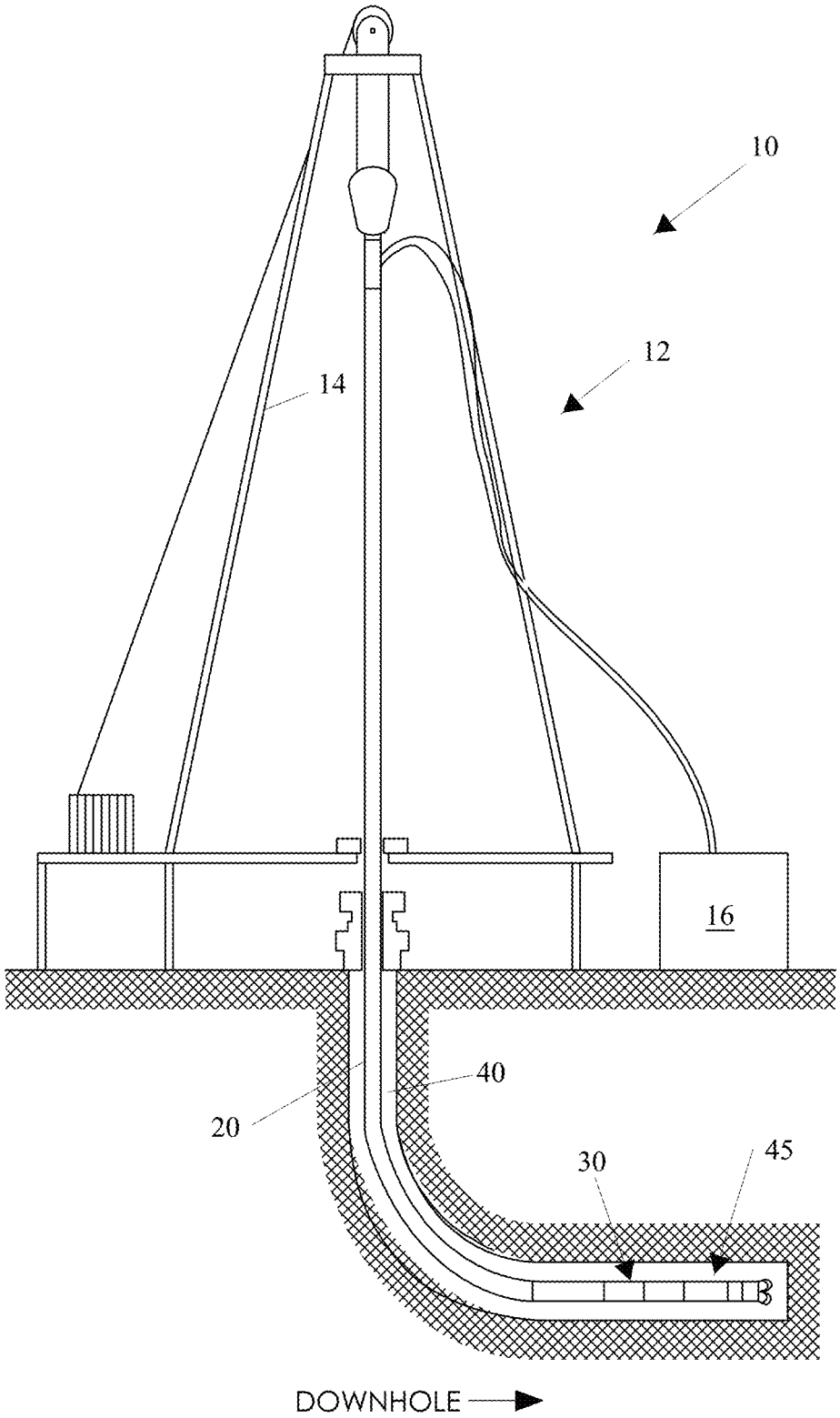
FIG. 1A is a schematic illustration of an exemplary drilling system having a drill string including a downhole valve apparatus of the present invention.

The present invention provides a downhole apparatus, which may be a downhole valve assembly or a downhole valve apparatus, which may be incorporated in a bottom hole assembly (BHA) of a drilling system, such as a drill string or a string of tubing. The downhole apparatus of the present invention may be used, for example, in drilling wells for recovery of hydrocarbon fluids from subterranean hydrocarbon deposits and in drilling wells into geothermal reservoirs. The downhole apparatus of the present invention may be further used in drilling wells for salt mining or for mineral mining, such as lithium mineral mining which may require leaching of the lithium mineral at the reservoir and the recovery of the mineral carrying slurry. The downhole apparatus of the present invention will be referred as the downhole valve apparatus hereinafter. The downhole valve apparatus of the present invention may include a valve housing, or a valve sub, housing a valve, such as a float valve. The valve housing may be a tubular body for incorporation in a string of tubing, which will be referred to as a drill string, preferably in the BHA section at the distal end of the string of a well. The float valve may be operably housed in the tubular body of the downhole valve apparatus.

As will be described more fully below, the valve housing may advantageously provide fatigue and stress reducing features in the BHA, such as including a boreback stress relief feature, while securely sealing the drilling system with the float valve against any unwanted reverse flow from a wellbore, or a downhole, and without interfering with the stress reducing features of the drilling system, thereby minimizing any drilling equipment malfunctions or failure resulting in hazardous operational conditions.

The float valve in the valve housing may allow passage of drilling fluids that may be pumped down from the surface to a drill bit of the BHA. However, the float valve may block any fluid flow in the reverse direction into the drill string in an event of a wellbore or downhole pressure event that may trigger a reverse fluid flow. A reverse fluid flow from a well may generally occur when the drilling fluid pumps on the surface are turned off or anytime that the wellbore pressure exceeds the pump pressure, which may cause a blowout on the surface that may result in loss of human life and equipment as well as ecological habitat. In such reverse fluid flow events, float valves may be the first line of defense against blowout catastrophes. This unwanted reverse flow resulting of a pressure event in the well may include a flow of liquid, gas, liquid and gas mixtures, or any solids carried by gas, liquid or their mixtures.

Accordingly, the valve housing of the downhole valve apparatus, as a component of a drill string BHA, may be a cylindrical tubular body having an inner chamber which may generally extend between a top opening at a top portion and a bottom opening at a bottom portion of the valve housing. The top portion of the valve housing may include a female section that may be removably fastened to a male section of an upper drill string tubular body or an upper BHA component. Similarly, the bottom portion of the valve housing may also be removably fastened to a lower drill string tubular body, or a lower BHA component, so that the upper drill string tubular body may be in fluid communication with the lower drill string tubular body, or a lower BHA component, through the inner chamber of the valve housing.

In one example, the lower string tubular body may contain a motor (drilling fluid motor or mud motor) of the BHA to drive the drill bit which is attached to the distal end of the BHA. The upper drill string tubular body may for example contain a stabilizer or another component of the BHA.

In one embodiment, the inner chamber of the valve housing may be configured to include a valve bore and a stress relief region to accommodate the float valve in the valve housing. In one embodiment, the stress relief region may be a bore (a stress relief bore) which may be a larger diameter extension of the valve bore. The stress relief bore may be formed between a top opening of the valve bore and the threaded section of the top portion of the valve housing.

When the downhole valve apparatus is assembled, a significant portion of the float valve may be held within the valve bore while also partially extending into the stress relief bore. When the upper BHA component and the valve housing are joined together by fastening male section (pin end) of the upper BHA component, including a tapered surface with threads to the female section (box end) of the valve housing, the end of the male section of the upper BHA component may be positioned adjacent the stress relief region after being fastened to the valve housing.

The float valve, having a hollow body with a top end with a top opening and a bottom end with a bottom opening, may be held partially in the valve bore. The float valve body may include a top section having a flow chamber that is in fluid communication with a valve chamber of a bottom section via a valve opening located between both chambers. The flow chamber may extend between the top opening and the valve opening, and the valve chamber extends between the valve opening and the bottom opening of the float valve body.

The outer surface of the flow chamber may include one or more seal grooves in a seal region located adjacent the valve opening of the float valve. Each groove may hold an exterior ring seal to prevent any fluid flow through an annular space between the outer surface of the flow chamber, i.e., the outer surface of the float valve, and the inner surface of the valve bore of the valve housing.

The valve chamber of the float valve may include a valve member, for example a flapper, that is configured to move between a closed position to close the valve opening and an open position to open the valve opening.

When the float valve is open, i.e., the valve member is in open position, a first flow (for example, drilling fluid, drilling solution, drilling mud or drilling slurry) from the upper BHA component in a first direction may be allowed to the lower BHA component. When the float valve is closed, i.e., the valve member is in closed position, the valve member may block a second flow from the lower BHA component (reverse flow from downhole) in a second direction toward the upper BHA component of the drill string.

Accordingly, in a first configuration of the downhole valve apparatus, the float valve is open, due to the pressure of the first flow (drilling fluid), and the bottom end of the float valve body may rest against a bottom shoulder of the valve bore of the valve housing. In the first configuration, there is a clearance gap between the top end of the float valve body and the lower end of the upper BHA component. In a second configuration of the downhole valve apparatus, the float valve is closed, due to the pressure of the second flow (the reverse flow from the wellbore), and the top end of the float valve body may rest against the lower end of the upper BHA component with an axial movement of the float valve in the valve bore.

The location of the seals (annual seals, ring seals or radial seals) on the outer surface of the flow chamber walls may be so selected that they are always stay in contact with the surface of the valve bore and seal an annular space between the float valve outer surface and the valve bore surface to prevent any fluid flow through the annular space, especially when the float valve is axially moved in the second configuration by the pressure of the reverse fluid flow against the closed valve member.

Turning now to the figures, FIG. 1A illustrates an exemplary drilling system 10 including a rig 12 having a derrick 14, and a mud pump 16 among other conventional equipment and parts. An exemplary drill string 20, or string of tubing 20, including a bottom hole assembly (BHA) 30 may be extended through a wellbore 40 and into a downhole region 45 for a drilling operation. The mud pump 16 of the drilling system 10 delivers a drilling fluid or drilling mud into the drill string 20 for the drilling operation.

Figure 1B:
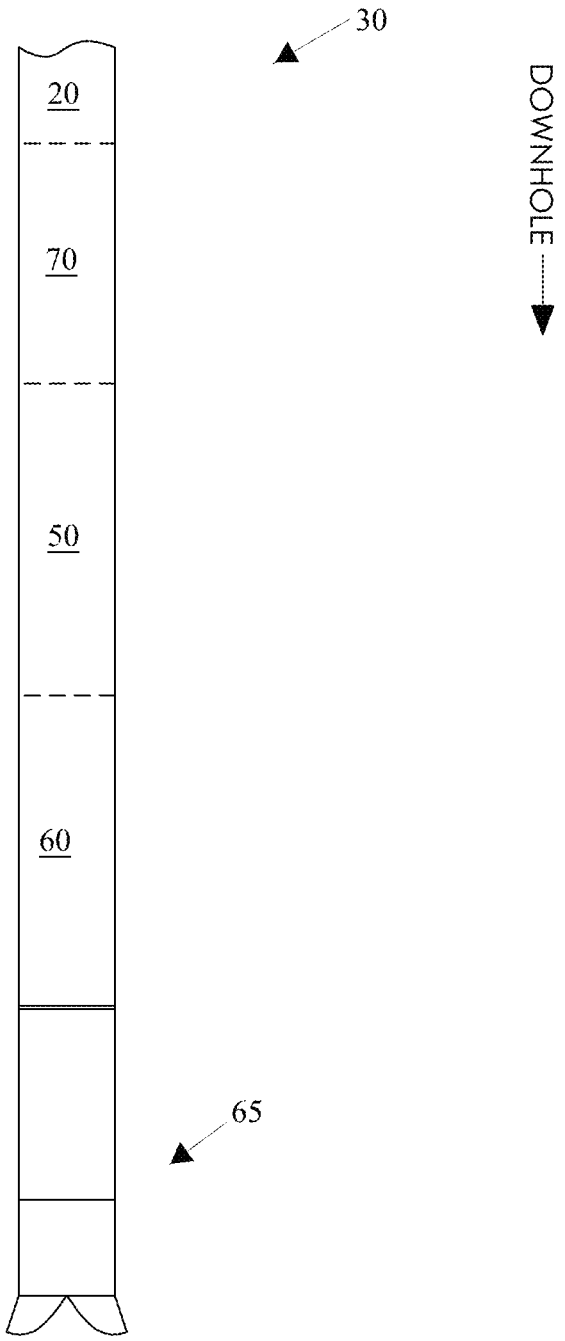
FIG. 1B is a schematic illustration of a bottom hole assembly (BHA) including the downhole valve apparatus.

As shown in FIG. 1B, an exemplary BHA 30 of the present invention may include a downhole valve apparatus 50, or a downhole valve assembly 50. The downhole valve apparatus 50 may be a tubular body for incorporation in a string of tubing 20. A lower end of downhole valve apparatus 50 may be connected to an upper end of a lower BHA component 60, (a lower drill string tubular body 60) as illustrated in FIG. 1B. The lower BHA component 60 may for example be a mud motor running a drill bit 65, or other additional BHA components. The upper end of the downhole valve apparatus 50 may be connected to a lower end of an upper BHA component 70 (an upper drill string tubular body 70). Other parts of the BHA 30 of the present invention may include conventional elements or parts, with their operation principles, that will be known to one of skilled in the art and are not described herein.

Figure 2A:
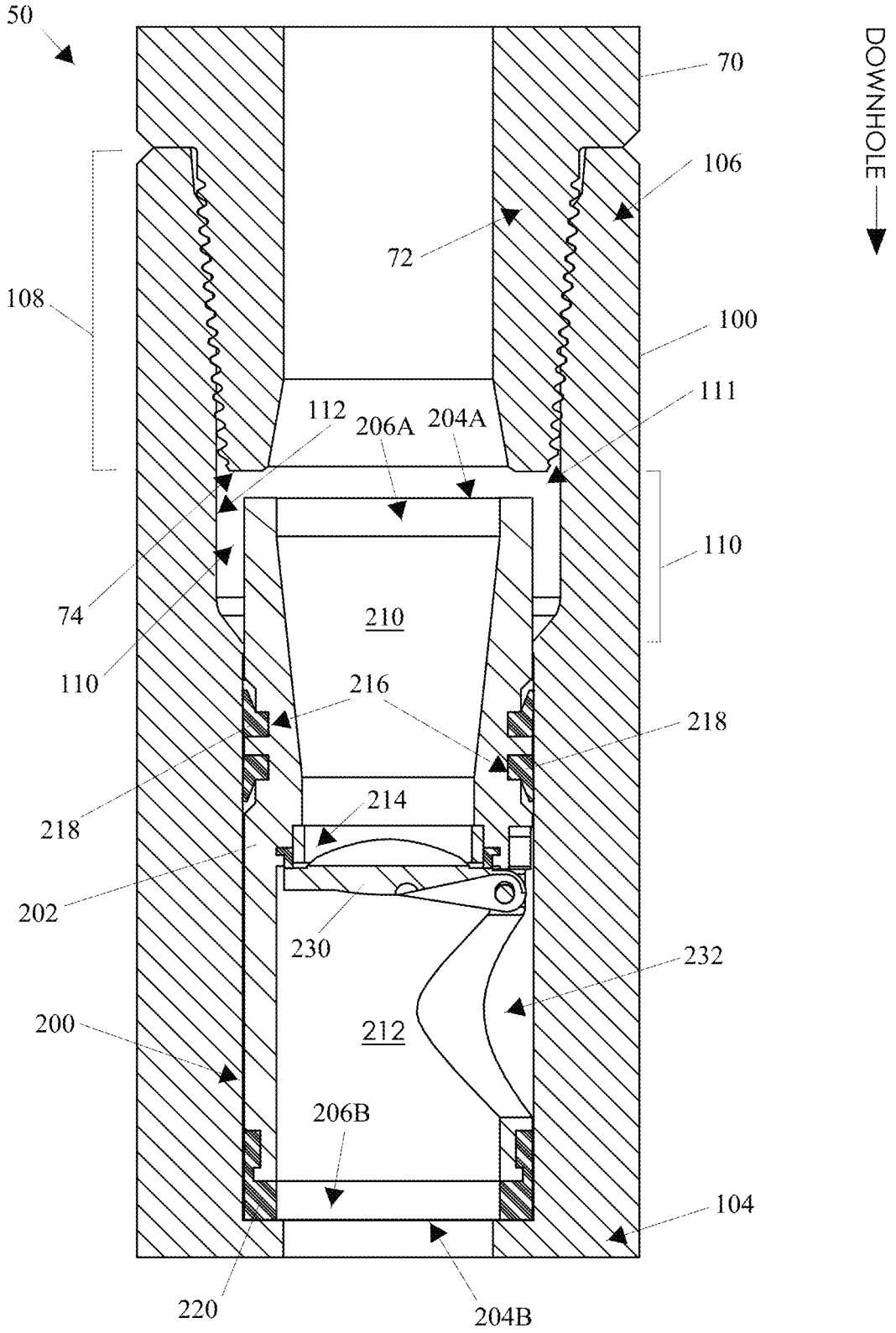
FIG. 2A is a schematic illustration of an embodiment of a downhole valve apparatus of the present invention having a valve housing including a float valve of the present invention.
Figure 2B:
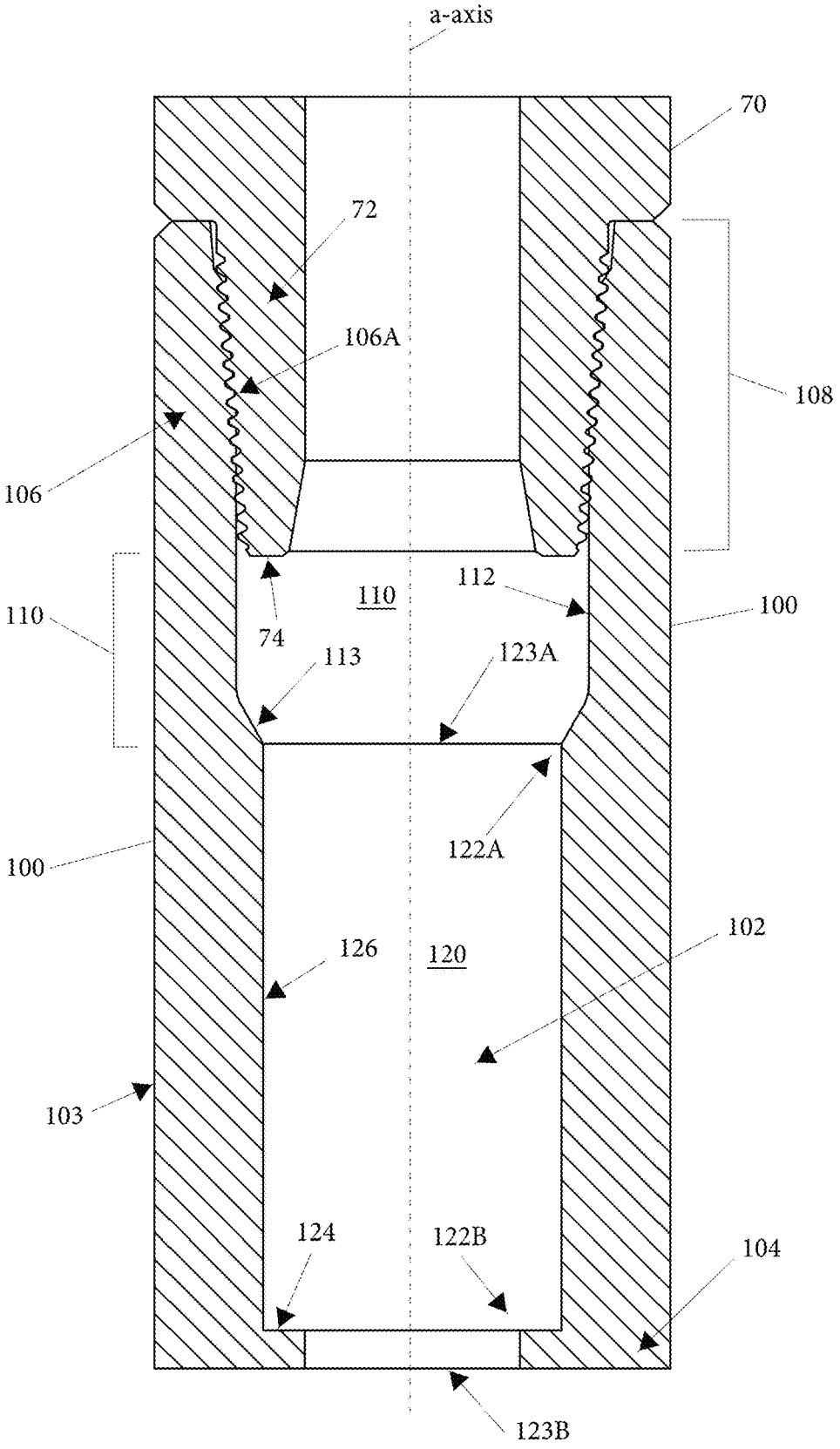
FIG. 2B is a schematic illustration of an embodiment of the valve housing including a stress relief bore.

FIGS. 2A and 2B illustrate, in side view, the downhole valve apparatus 50 of the present invention in connection with the upper BHA component 70. In accordance with the principles of the present invention, the downhole valve apparatus 50 may be comprised of a valve housing 100 housing a valve 200 in an inner chamber 102, or an inner bore 102 of the tubular body of the valve housing 100. The inner bore 102 of the of the valve housing may include a stress relief bore 110 and a valve bore, along an axis of rotation denoted as a-axis of the valve housing 100, to house the valve 200 of the present invention, which may be a float valve.

In FIG. 2A, the float valve 200 is illustrated as assembled in the inner bore 102 of the valve housing 100 before any operation and without any fluid flow, i.e. no drilling fluid flow from the surface and no reverse fluid flow from the downhole, in order to clearly describe the features of the downhole valve apparatus 50. FIG. 2B illustrates the tubular body of the valve housing 100, including the inner bore 102, without the valve 200 for clarity. In FIG. 2A, there is shown the stress relief bore 110, or a boreback stress relief region 110, which may include a valve clearance gap 111 within the stress relief bore 110 (also shown in FIGS. 5A-5C). The valve clearance gap 111 may be located between a top end 204A of a tubular body 202 of the float valve 200 in the valve housing 100, and a bottom surface 74 of a bottom portion 72 of the upper BHA component 70 when the downhole valve apparatus 50 and the upper BHA component 70 are assembled together in the BHA 30 for a drilling operation (see also FIGS. 1A-1B).

The valve clearance gap 111 may provide a sufficient room to account for differences in manufacturing of the standard API (American Petroleum Institute) connections. API allows these differences to allow for many different levels of precision of machining equipment commonly used in the industry. Tighter requirements may add unnecessary cost pressure on manufacturing of these connections. API standards 7-1 and 7-2 may govern these connections.

Referring back to FIGS. 2A and 2B, the valve housing 100 may be a tubular (cylindrical) body, or a cylindrical housing including an inner chamber 102 extending between a bottom portion 104 and a top portion 106 of the valve housing 100. The bottom portion 72 of the upper BHA component 70 (the upper tubular string component 70) having the bottom surface 74, may be joined to the valve housing 100 at the top portion 106. In this respect, when the top portion 106 of the valve housing 100 is connected to the bottom portion 72 of the upper BHA component 70, a joint region 108 is formed. As also mentioned above, the top portion 106 of the valve housing 100 and the bottom portion 72 may include tapered female and male connection surfaces, respectively, having threads to removably fasten, or engage, the valve housing 100 and the upper BHA component 70 while allowing fluid flow therethrough.

In the drilling terminology, the upper portion 106 of the valve housing 100 with a female connection surface is called 'a box end' (or a box) and the bottom portion 72 of the upper BHA component 70 with a male connection surface is called 'a pin end' (or pin). Such pin and box connections are well known connection or fastening features to connect, for example various components (tubular bodies) of the BHA or the drill string. As shown in FIG. 2A, at the joint region 108, i.e., where the top portion 106 of valve housing 100 and the bottom portion 72 of the upper BHA component 70 are connected, the combined side wall thickness of both ends is greater than the side wall thickness of a stress relief region 110. The stress relief bore 110 may be a box 'boreback' stress relief feature at the top portion 106, or the box end, of the valve housing 100.

The bottom end 104 of the valve housing 100 of the downhole valve apparatus 50 may be connected to the lower BHA component 60 (FIG. 1B) using the above mentioned pin and box connection technology or other connection means so that the upper BHA component 70 as well as the drill string 20 may be in fluid communication with the lower BHA component 60 through the downhole valve apparatus 50. The lower BHA component 60 may for example contain a motor (drilling fluid motor or mud motor) of the BHA to run the drill bit 65 using the drilling fluid delivered to the motor. The upper BHA component 70 may for example contain a stabilizer or another component of the BHA 30 (FIGS. 1A-1B).

Referring to FIG. 2B, the valve bore 120 of the valve housing 100 may have a first end 122A adjacent the stress relief bore 110 and a second end 122B at a shoulder 124 adjacent the bottom end 104. The first end 122A of the valve bore 120 includes a top valve bore opening 123A having a diameter that is equal to the diameter of the valve bore. The second end 122B of the valve bore 120 includes a bottom valve bore opening 123B which is defined by the valve bore shoulder 124. The diameter of the top valve bore opening 123A is greater than the diameter of the bottom valve bore opening 123B. The stress relief bore 110 may have a cylindrical side wall 112 formed in the top portion 106 of the valve housing 100 by reducing the thickness of the cylindrical side wall 103 surrounding the valve bore 120. Thus, the stress relief region may be a larger diameter extension of the valve bore 120 and positioned between the top valve bore opening 123A of the valve bore 120 and the threaded surface 106A of the top portion 106. The side wall 112 of the stress relief bore 110 may be located between the beginning of the threaded surface 106A and the top valve bore opening 123A of the valve bore 120. A tapered section 113 of the side wall 112 may provide a smooth transition between the cylindrical surface of the side wall 126 of the valve bore and the cylindrical surface of the side wall 112 of the stress relief bore 110. When the upper BHA component 72 and the valve housing 100 are joined by engaging their respective threads to form the joint region 108, the bottom surface 74 of the upper BHA component, i.e., the pin end, is positioned adjacent the stress relief bore 110. The thickness of the side wall 112 of the stress relief bore 110 may be less than the thickness of the side wall 126 of the valve bore 120 as well as the joint region 108, as seen in FIG. 2B. The reduced thickness of the side wall 112 of the stress relief bore 110 may be formed by machining.

Fatigue failures in drill strings, especially at the joints of the connected tubes, or adjacent the joints, of the BHA may be caused by rotation and bending actions taking place during a drilling operations. In order to increase the fatigue life of the joints or components of the BHA and the drill string, thin walled and relatively flexible stress relief regions may be formed next to thick walled joint regions to reduce the effects of bending stresses at the joints.

Figure 11:
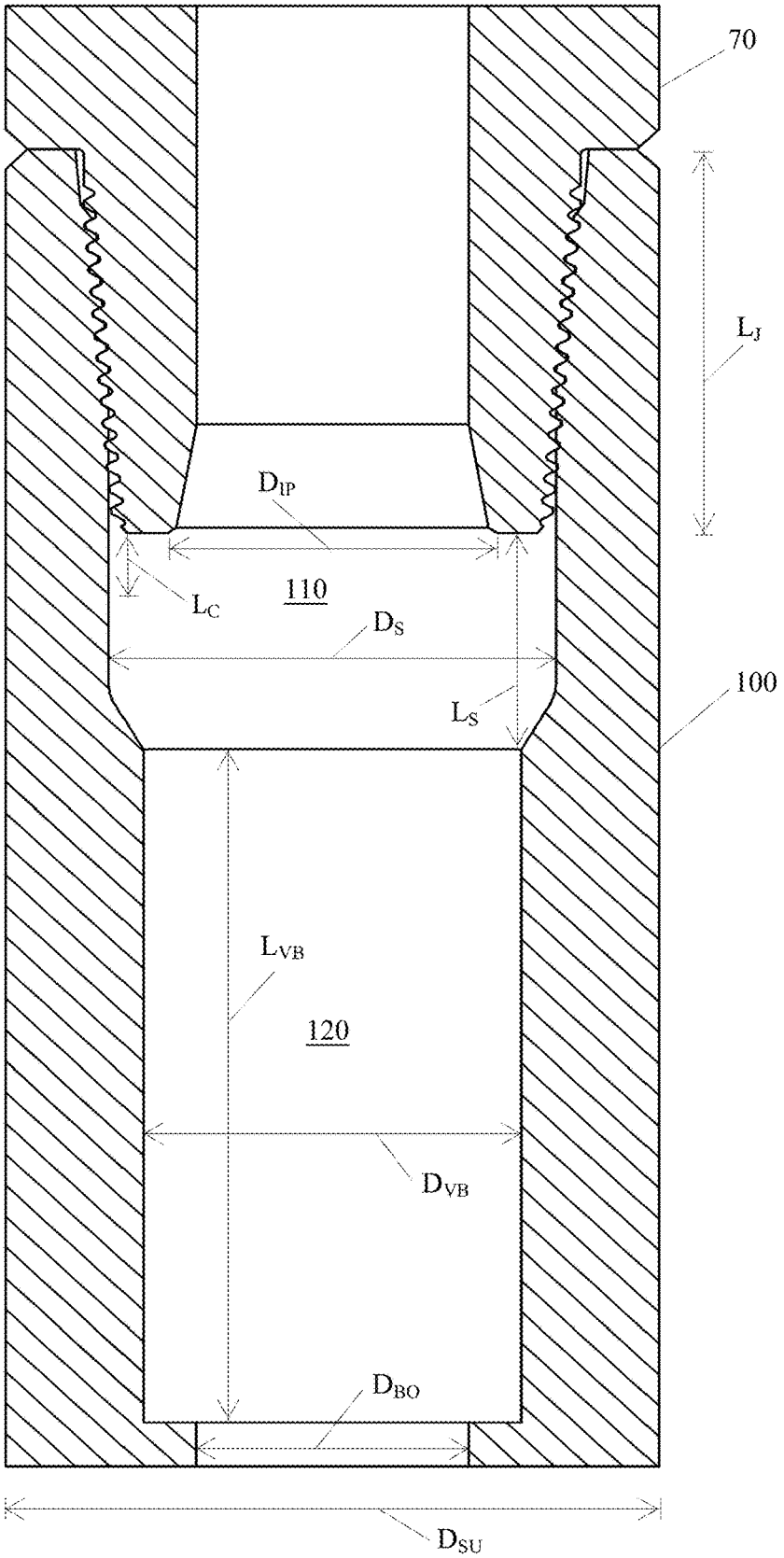
FIGS. 11 and 12 show dimensions of the valve housing and the float valve of the downhole valve apparatus in side view.

Referring to FIGS. 2B and 11, and tables in FIGS. 13A and 13B, accordingly, in one embodiment, the valve housing 100 may have the following exemplary dimensions (in inches) (for the connection type NC50): Outer diameter ($D_{SU}$) of the valve housing 100, or tool size, may be in the range of about 6¼-7¼, or about 6¾; Diameter ($D_{VB}$) of the valve bore 120 may be in the range of about 3.90-3.93; Bottom opening diameter ($D_{BO}$) of the valve bore 120 may be in the range of about 2.90-3.050; Length ($L_{VB}$) of the valve bore 120 may be in the range of about 7.60-7.70; Length ($L_J$) of the joint region 108 (NC50) may be in the range of about 4.35-4.50; Inner diameter ($D_{IP}$) of the end 74 of pin 72 may be in the range of about 3.219-3.281; Length ($L_S$) of the stress relief bore 110 may be in the range of about 2.23-2.30; Length ($L_C$) of the valve clearance gap 111 may be in the range of about 0.188-0.438; and, inner diameter ($D_S$) of the stress relief bore 110 may be in the range of about 4.60-4.65.

Figure 2C:
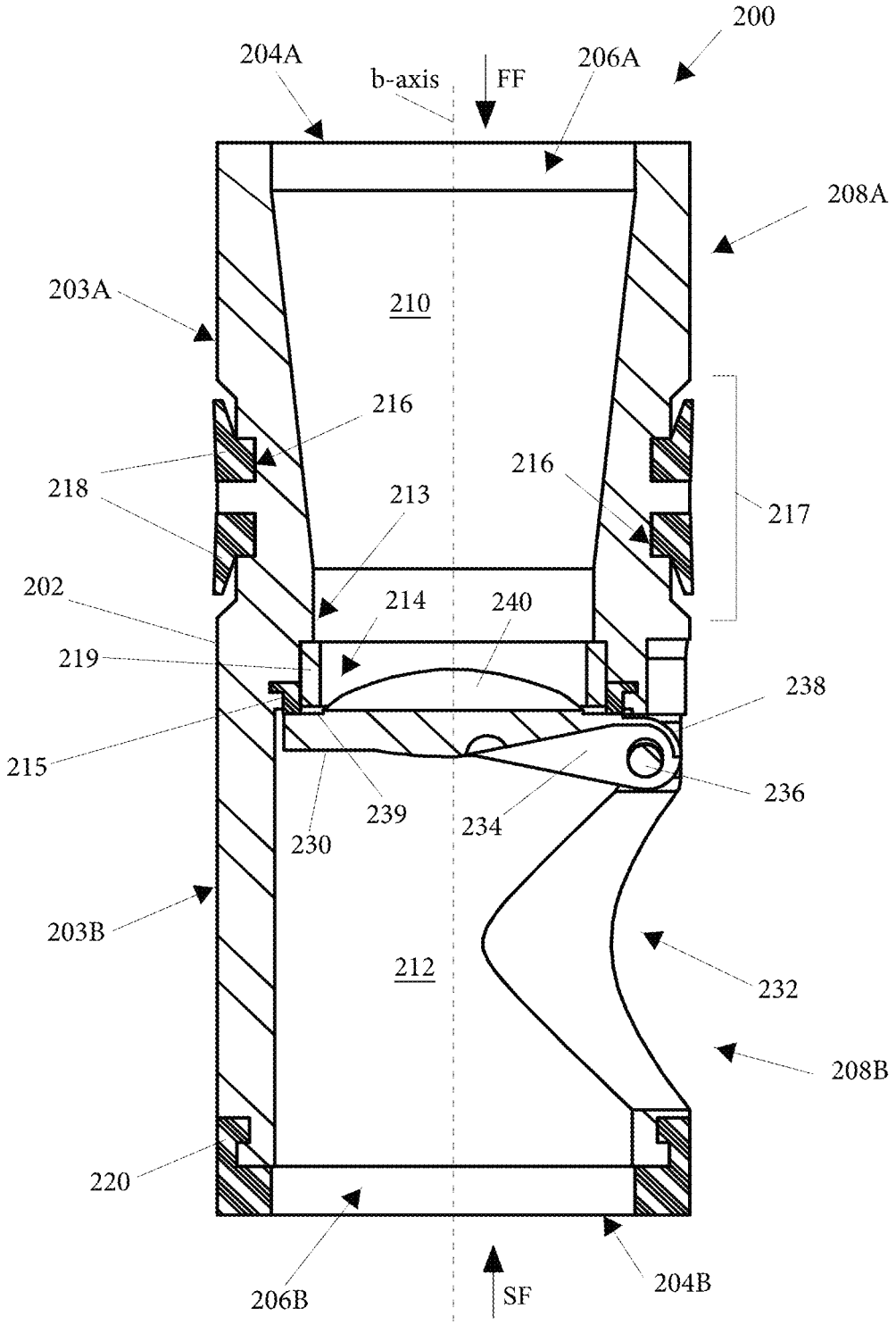
FIG. 2C is a schematic illustration of the float valve of the present invention.

Referring to FIGS. 2C and 2A, the body 202 of the float valve 200 includes a top opening 206A at the top end 204A and a bottom opening 206B at a bottom end 204B. The valve body 202 may be a tubular body defined by a cylindrical side wall 203. The outer diameter of the float valve body 202 is slightly less than the diameter of the valve bore 120 of the valve housing 100 so as to allow axial movement of the float valve within the valve bore 120. The float valve 200 may be movably held at least partially in the valve bore 120 defined by the cylindrical side wall 103 of the valve housing 100 (FIG. 2B).

The valve body 202 may include a top section 208A having a flow chamber 210 that is in fluid communication with a valve chamber 212 of a bottom section 208B via a valve opening 214 located between the chambers 210 and 212. The valve opening 214 may connect the flow chamber 210 to the valve chamber 212. The valve opening 214 may be a scalable opening including a valve opening seal 215, which is an annular seal, and a retainer sleeve 219, or ring 219, of the seal 215.

The flow chamber 212 may extend between the top opening 206A and the valve opening 214 and surrounded by a flow chamber side wall 203A, top portion of the side wall 203 of the valve body 202. The valve chamber 212 may extend between the valve opening 214 and the bottom opening 206B and surrounded by valve chamber side wall 203B, bottom portion of the side wall 203 of the valve body 202.

The flow chamber side wall 203A may be uniformly tapered so that the inner diameter of the flow chamber 203A is reduced toward the valve opening 214, resulting in a thicker wall adjacent the valve opening 214. A collar portion 213, or a ring portion 213, of the flow chamber 203A, has the narrowest inner diameter of the flow chamber 203A and connects flow chamber 203A to the valve opening 214. In order to reduce or eliminate mechanical vibrations and mechanical damages in the valve body 202 of the float valve 200 under operation conditions, the edge of the bottom opening 206B may have an end ring 220. The end ring 220 may absorb shocks acting as bumper protecting the bottom end 204B of the float valve 200. The end ring 220 may also form fluid proof seal with the surfaces that it is in contact.

As will be described below, in a first configuration of the downhole valve apparatus 50, in addition to annular seals 218 on the float valve surface, the end ring 220 may seal the space between the bottom end of the float valve 200 and the valve bore 120. This may further prevent any turbulence forming fluid leak in the first fluid flow 'FF' and allows only the turbulence free fluid flow through the float valve 200. In another embodiment of the present invention, the edge of the top opening 206A may also include a top end ring and it is within the scope of this invention. In that case, similarly, in a second configuration of the downhole valve apparatus 50, in addition to annular seals 218 on the float valve surface, the top end ring may seal the contact surfaces between the top end of the float valve 200 and the bottom surface 74 of the upper BHA component and further prevent any fluid leak into to the drill string from the second fluid flow 'SF'. End rings 220 may be made of elastomeric materials or rubber, or other materials having shock absorbing and sealing material properties.

The outer surface of the flow chamber side wall 203A may include one or more seal grooves 216 in a seal region 217 of the side wall 203A which is near the location of the valve opening 214 and adjacent the narrowest inner diameter of the inner bore section 205A where the flow chamber side wall 203A is substantially thick. Each groove 216 in the seal region 217 may hold an annular seals 218 (radial seals 218 or valve body seals 218) to prevent any fluid flow through the annular space between the outer surface of the flow chamber side wall 203A and the surface of the valve bore 120. Particularly, forming the seal grooves 216 in the thicker portion of the tapered flow chamber side wall 203A may increase to the mechanical stability of the float valve 200 against the compressive forces exerted during the operation as well as extend the sealing performance life time of the float valve 200. In the figures, although, for the purposes of clarity, the sealing surfaces of the annular body seals 218 are shown as flat surfaces, the sealing surfaces of the annular body seals may be protruding convex surfaces. The annual seals 218 may be elastomeric seals.

Referring to FIGS. 2C, 12, and FIGS. 13A-13B, all the dimensions shown in figures of the application may be the most common rendition of this invention. In the drilling industry, the most commonly used connection is the NC50 which uses a "5R" size valve. The "5R' valve is the valve with the maximum flow capability that can fit in the connection used. Valve sizes "2F3R", "3½IF", "4R", "5R" and "5F6R" are some of the standard sizes of valves used in the industry.

Figure 12:
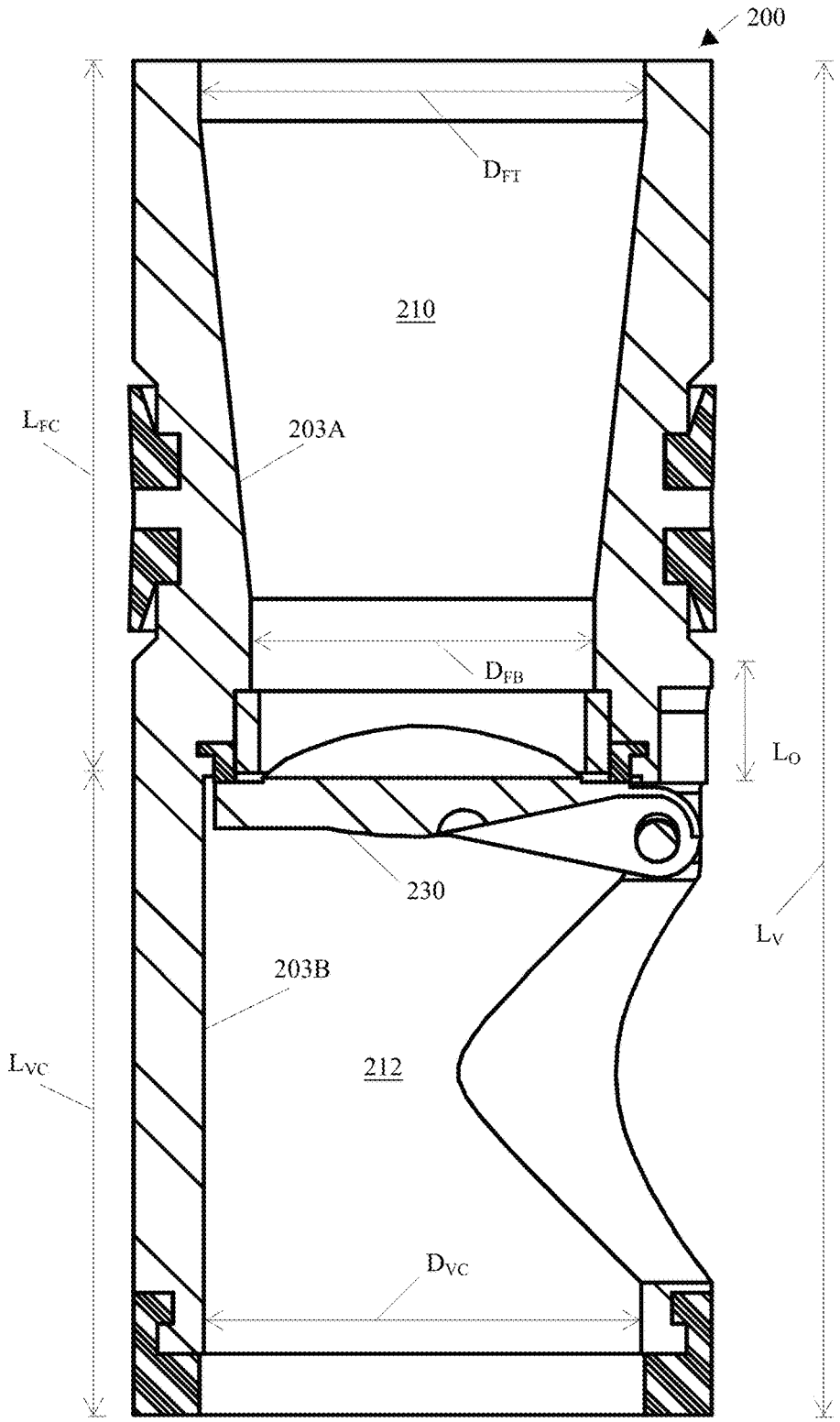

Referring to FIGS. 2C and 12, the optimum location of the valve opening seal 215 on the float valve body 202 may be determined using the following equation (1):

$$L_{vc}=R\times D_{vc} \quad (1)$$

Where $L_{vc}$ is the distance from the bottom of the float valve 200 to the valve opening seal 215, $D_{vc}$ is the inside diameter of the valve chamber 212, and R is a defining coefficient in the range of 1.33 to 1.51.

The optimum location of the lower edge of the seal region 217 on the float valve body 202 may be determined using the following formula (2):

$$L_{vc}=(R\times D_{vc})+L_O \quad (2)$$

Where $L_O$ is an additional distance to account for the biasing spring envelope of each valve size as shown in FIG. 12.

Referring to FIG. 2C and FIGS. 7A-8B, the valve chamber 212 of the float valve 200 may include a valve member 230, for example a circular flapper or lid, which is movable between a closed position to close the valve opening 214 and an open position to open the valve opening 214. In the open position, the valve member 230 is configured to open the valve chamber 212 to allow a first fluid flow 'FF', or a first flow 'FF', (for example, drilling fluid or mud to run the mud motor), for example, from the upper BHA component 70 in a first direction 'FD' to the lower BHA component 60 via the float valve 200 of the valve housing 100. In the closed position, the valve member 230 is configured to close the flow chamber 210 to block a second fluid flow 'SF', a second flow 'SF', from the lower BHA component 60 (reverse fluid flow from the wellbore into the BHA) in a second direction 'SD' toward the upper BHA component 70.

When the valve member 230 is brought to the open position with a predetermined pressure of the first flow 'FF', the valve member 230 may move into a valve port 232 with the fluid pressure (e.g., hydraulic pressure), and may be retained in the valve port 232 as long as the fluid pressure is applied. The valve port 232 may be a circular opening in the valve chamber side wall 203B which is sized and shaped to comply with the shape of the valve member 230 so that the valve member 230 fits in the valve port 232 and does not restrict the first flow 'FF'. A retainer section 236 of the valve member 230 may be supported by a hinge 234 attached to the valve chamber side wall 203B at the top most end of the circular valve port opening 232 adjacent the valve opening 214. A bias member 238 of the valve member 230 may bias the valve member to the closed position, to seal the valve opening 214, which is the rest position of the valve member 230. The bias member 238 may be a coil spring, or a flat spring, configured to be attached to the hinge 234 and the valve member 230.

Referring to FIGS. 2C and 12 and the tables in FIGS. 13A-13B, in one embodiment, the float valve 200 may have the following exemplary dimensions (in inches) (for the connection type NC50): Length ($L_V$) of the float valve 200 may be in the range of about 9.70-9.850; Length ($L_{FC}$) of the flow chamber 210 may be in the range of about 4.50-4.60; Inner diameter ($D_{FT}$) of the top opening 206A and inner diameter ($D_{VC}$) of the bottom opening 206B may be in the range of about 2.90-3.02; Inner diameter ($D_{FB}$) of the lower end of the flow chamber 210, where the side wall 203A is thickest, may be in the range of about 2.30-3.35.

Figure 3A:
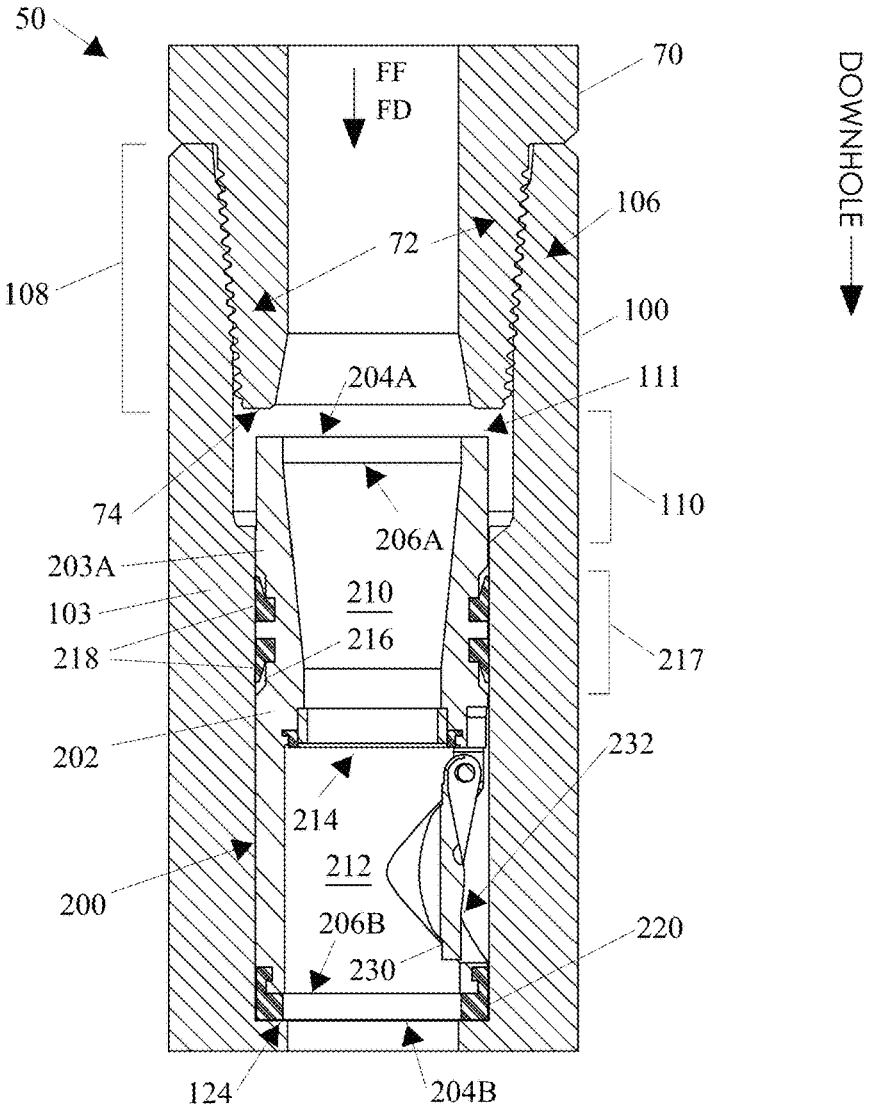
FIG. 3A is a schematic illustration of an embodiment a downhole valve apparatus wherein the float valve is in open position in first configuration.

Referring to FIG. 3A, the downhole valve apparatus 50 of the present invention is shown in an exemplary operation condition during a drilling as a part of the BHA 30 (shown in FIGS. 1A-1B). Before a drilling operation or any fluid flow in either direction, the float valve 200 may be in the closed position, i.e., the valve opening 214 is sealed by the valve member 230. In this respect, the valve member 230 is in rest position, or in normal position, due to the bias applied to the valve member 230. At this stage, the float valve 200 can be either resting on the valve bore shoulder 124 (FIG. 2B) in the valve bore 120, or axially elevated from the shoulder 124 in the valve bore 120 by a distance equal to the valve clearance gap length Lc or less than the valve clearance gap length Lc (FIG. 11).

Figure 5A:
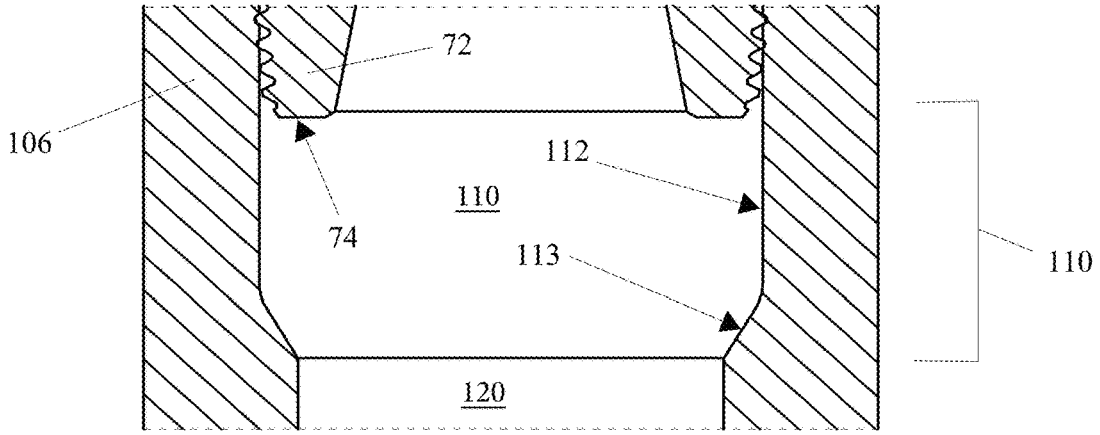
FIGS. 5A-5C are schematic illustrations of the stress relief region without the float valve and when the float valve is in closed and open positions, respectively.
Figure 5B:
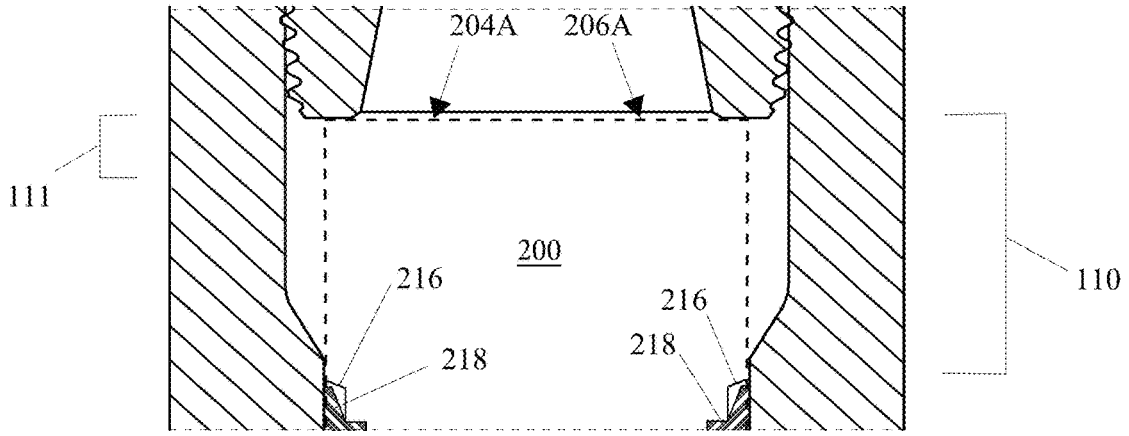
Figure 5C:
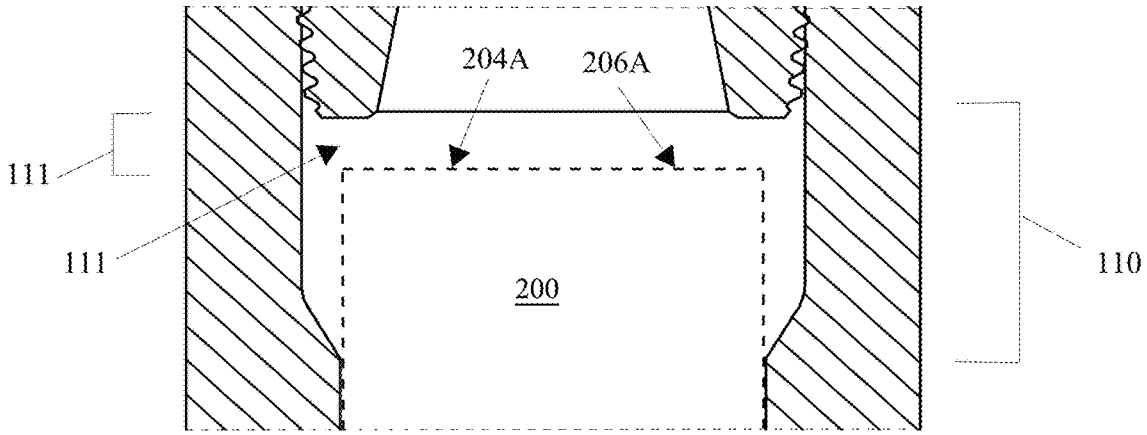

Referring to FIGS. 3A and 5C, however, during a drilling operation, as the drilling fluid pumped down into the drill string as first flow 'FF' in the first direction 'FD' into the downhole valve apparatus 50, the pressure exerted by the fluid filling both the stress relief region 110 and the flow chamber 210 of the float valve 200 may overcome the biasing force on the valve member 230 and pushes the valve member to the open position allowing the first flow 'FF' to continue towards the drill bit at the distal end of the string. The pressure of the first fluid flow 'FF' flowing through the float valve 200 may axially move the float valve 200 in the first direction 'FD'. This operational condition will be called a first configuration of the downhole valve apparatus 50 when the float valve 200 opens and axially moves, in the valve bore 120 of the valve housing 100, in the first direction 'FD' of the first fluid flow 'FF'. For example, during a drilling operation, the pressure of the second fluid flow (downhole pressure) may exceed about 20,000 psi. Under this condition, if the pressure of the first fluid (weight of the drilling fluid) in addition to the pressure from the drilling fluid pump drop below 20,000 psi, the float valve will be closed.

The tapered side wall structure of the flow chamber 210 may advantageously provide a turbulence-free flow through the float valve 200 when the float valve is open. The turbulence free flow of the drilling fluid may increase the drilling efficiency and prevent drill bit failures in the wellbore.

The pressure of the first fluid flow 'FF' axially moves the float valve 200 in the valve bore 120 toward the shoulder 124 to rest it on the shoulder 124. This may happen if there is any distance between the bottom end 204B of the float valve 200 and the shoulder 124 of the valve bore 120. In the first configuration of the downhole valve apparatus 50, the float valve 200 may rest on the shoulder 124 of the valve bore 120 with the valve member 230 is in open position. In the first configuration, the entire clearance gap length Lc will be available between the joint region 108 and the top end 204A of the float valve 200 as shown in FIG. 5C.

Accordingly, since there is no contact between the float valve 200 and the joint region 108, the float valve 200 will be protected from any damage caused by the bending forces occurring along the drill string during the drilling operation using the first fluid flow 'FF'.

Figure 3B:
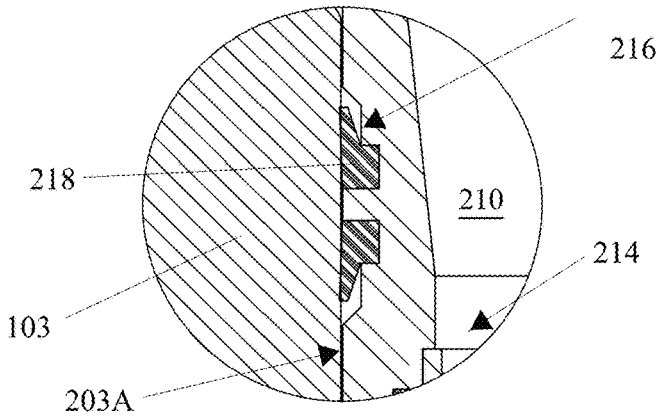
FIG. 3B is a schematic illustration of the location of the annular surface seals of the float valve when the float valve is in open position in first configuration.

FIG. 3B shows the position of the annular body seals 218 of the float valve in the first configuration when the float valve 200 is open and at the end of the valve bore 120. In this configuration, the annular body seals 218 are away from the stress relief region 110 and effectively seals the annual space between the float valve 200 and valve bore 120.

Figure 4A:
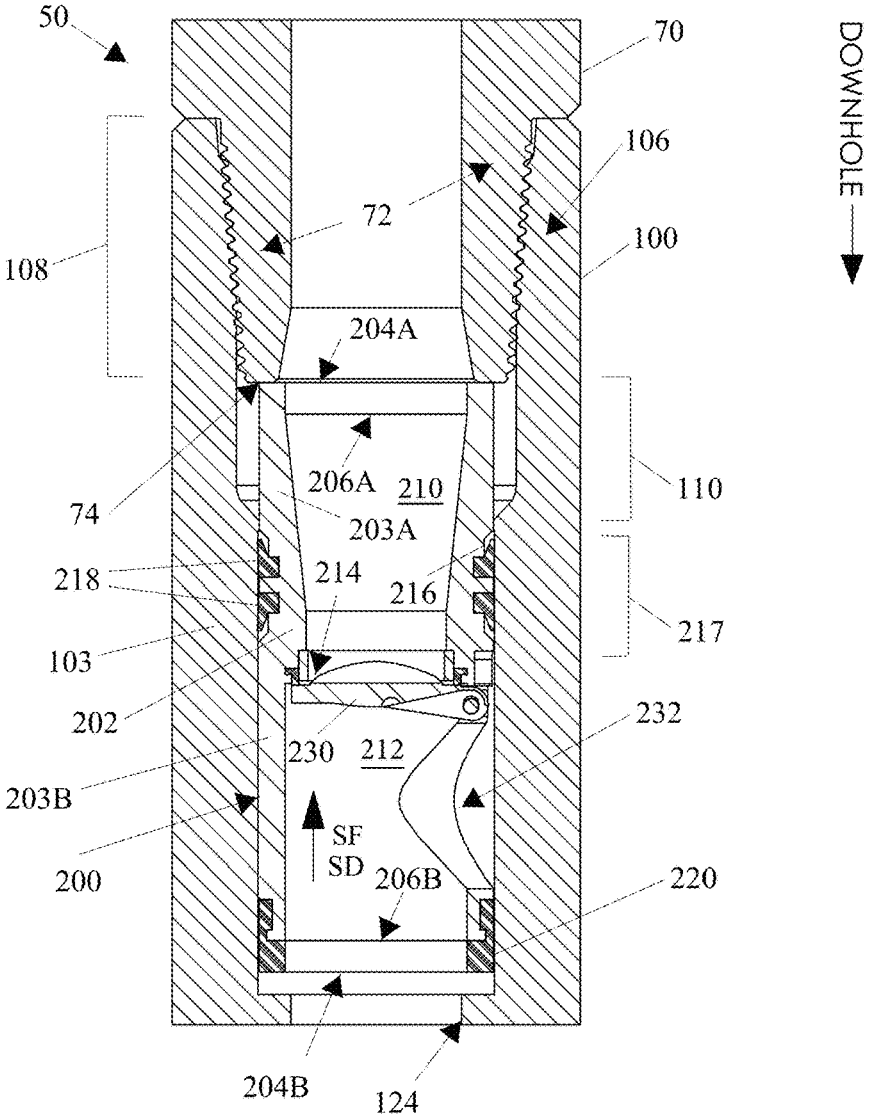
FIG. 4A is a schematic illustration of an embodiment a downhole valve apparatus wherein the float valve is in closed position in second configuration.

Referring to FIGS. 4A and 5B, following the drilling operation example described above, if the pumping of the first fluid flow 'FF' is either stopped or disrupted during the process, the resulting pressure loss may re-bias the valve member 230 to close position, which may result in closing the float valve 200 against the second fluid flow 'SF', i.e., reverse flow from the downhole due to the loss of the pressure exerted by the first fluid flow 'FF'. The pressure of the second fluid flow 'SF' on the valve member 230, in closed position, may move the float valve 200 axially within the valve bore 120 toward the joint region 108 so that the top end 204A of the float valve 200 moves into the clearance gap 111 and rests against the surface 74 in the joint region 108, i.e., the lower end 72 of the upper BHA component 70. This operational condition will be called a second configuration of the downhole valve apparatus 50, when the float valve 200 closes and axially moves, in the valve bore 120 of the valve housing 100, in the second direction 'SD' of the second fluid flow 'SF', resulting in resting the float valve 200 against the joint region 108 by axially moving a distance equal to the valve clearance gap length.

In another operation example of the second configuration of the downhole valve apparatus 50, the pressure of the second fluid flow 'SF' may overcome the pressure of the first fluid flow 'FF' which is pumped down to BHA from the mud pump during a drilling process. The resulting pressure loss in the first fluid flow 'FF' may re-bias the valve member 230 to the close position resulting in sealing the float valve against the second flow 'SF'. The pressure of the second fluid flow 'SF' on the valve member 230, in the closed position, may then move the float valve 200 axially within the valve bore 120 toward the joint region 108 so that the top end 204A of the float valve 200 moves into the clearance gap 111 and rests against the surface 74 in the joint region 108, as described above.

Figure 4B:
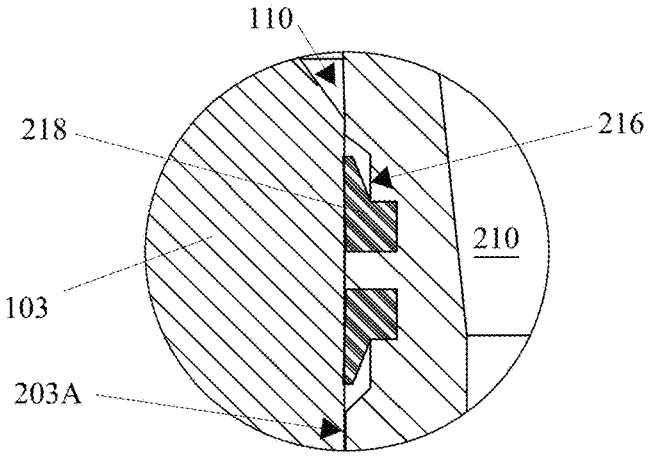
FIG. 4B is a schematic illustration of the location of the annular surface seals of the float valve when the float valve is in closed position in second configuration.

As shown in FIG. 4B, in the second configuration, because of the location of the annular body seals 218 on the outer surface of the flow chamber side walls 203A, the seals 218 always stay on the surface of the float valve bore 120 and seal the annular space between the float valve 200 and the valve bore 120, thereby preventing any fluid from bypassing the float valve through the annular space in the second direction SD.

FIGS. 5A, 5B and 5C schematically illustrate, in partial side view, the stress relief bore 110 of the valve housing 100 without the float valve 200, with the float valve 200 in the second configuration, and with the float valve 200 in the first configuration, respectively. As shown in FIG. 5B, in the second configuration, as described above, the top end 204A of the float valve 200 is in contact with the upper BHA component 70. With the upward axial motion of the closed float valve caused by the second fluid flow, the top end 204A of the float valve 200 may occupy the valve clearance gap 111. As shown in FIG. 5C, in the first configuration, as described above, the valve clearance gap 111 may form between the top end 204A of the open float valve and the upper BHA component 70 with the downward axial motion of the float valve 200 caused by the pressure of the first fluid flow.

Figure 6A:
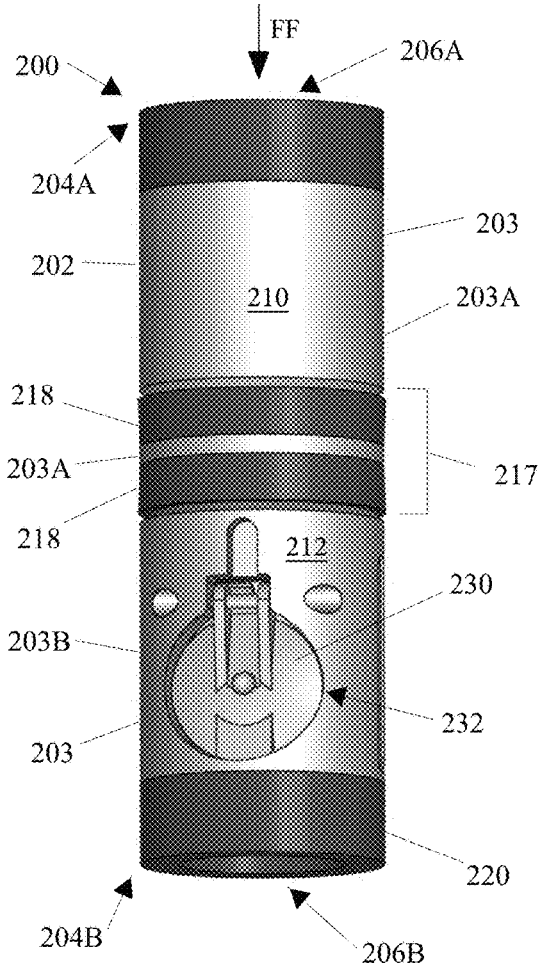
FIGS. 6A-6B are schematic illustrations of an exemplary float valve of the present invention in perspective view showing closed and open positions respectively.
Figure 6B:
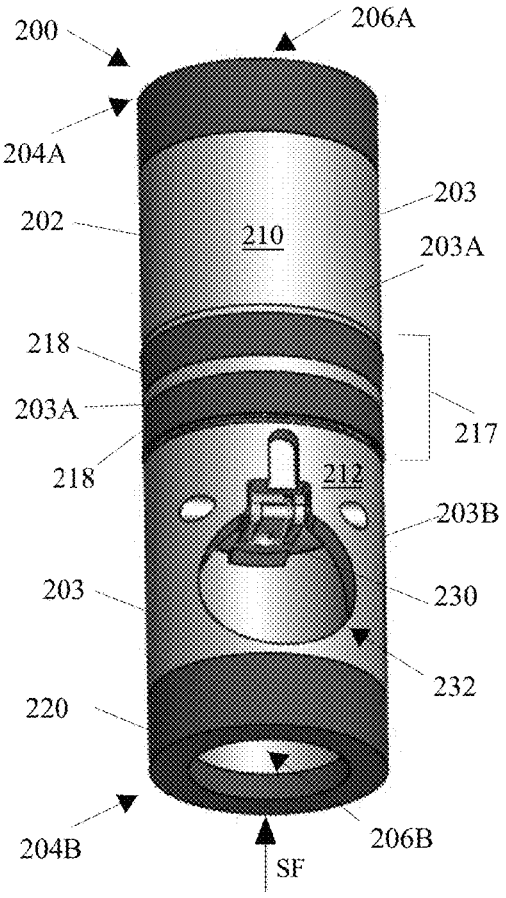

FIGS. 6A and 6B illustrate in perspective view, in an embodiment, the seal regions 217 with the annular seals 218 on the outer surface of the float valve 200. The annular seals 218 are located at the lower end of the upper chamber 210, or the flow chamber 210, of the float valve 200, as described above. FIG. 6A shows the valve member 230 of the float valve 200 in the open position and FIG. 6B shows the valve member 230 in the closed position.

Figure 7A:
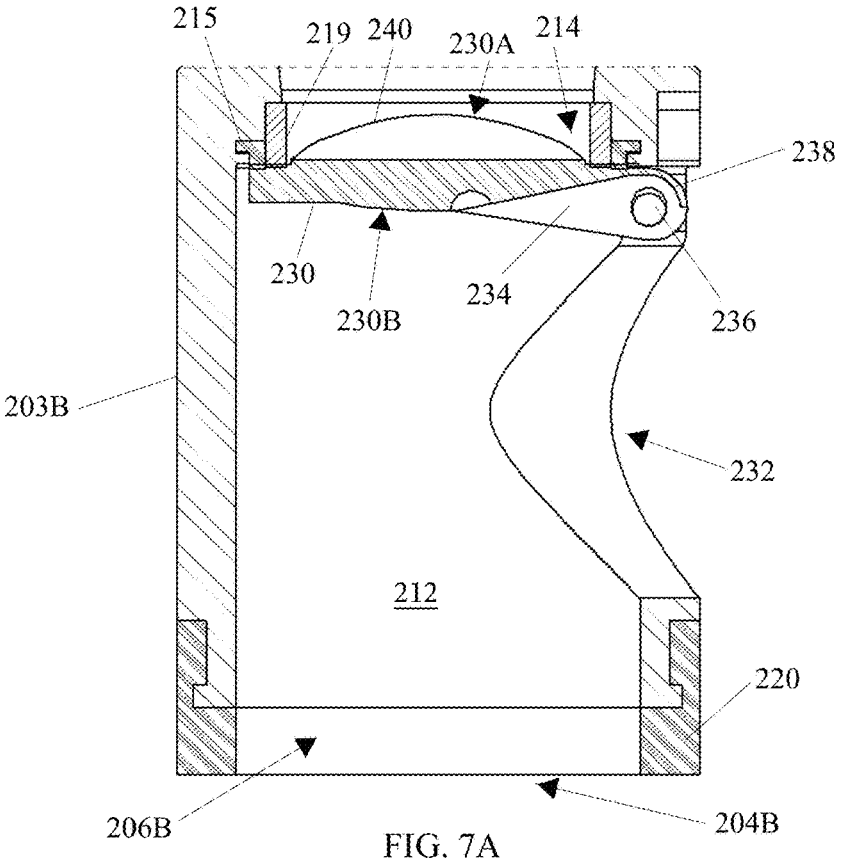
FIGS. 7A-7B are schematic illustrations of the valve chamber of the float valve in closed position.
Figure 7B:
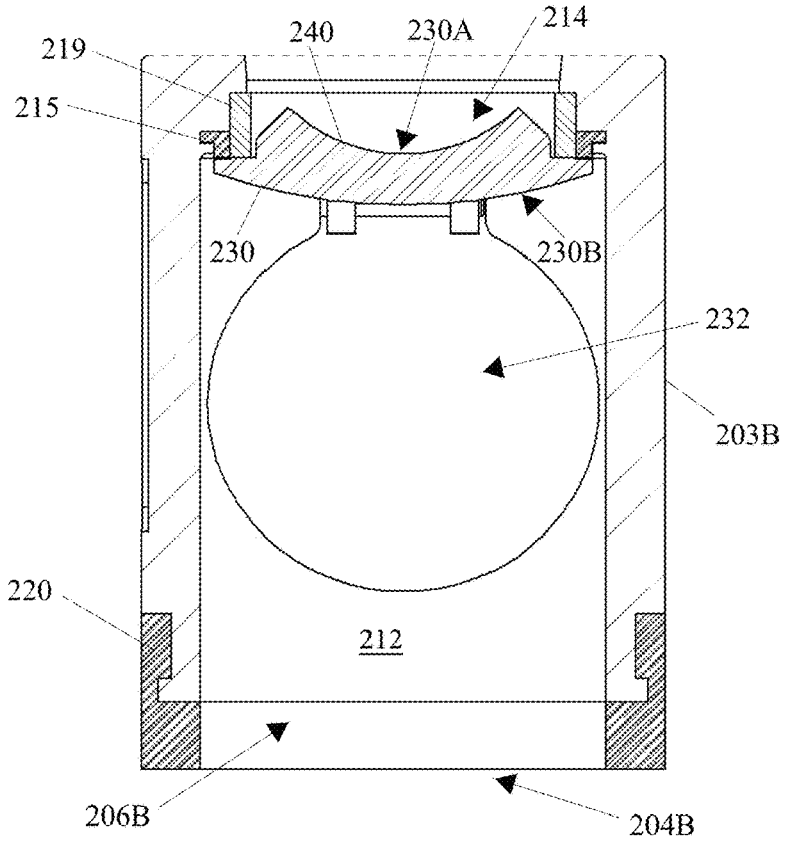
Figure 8A:
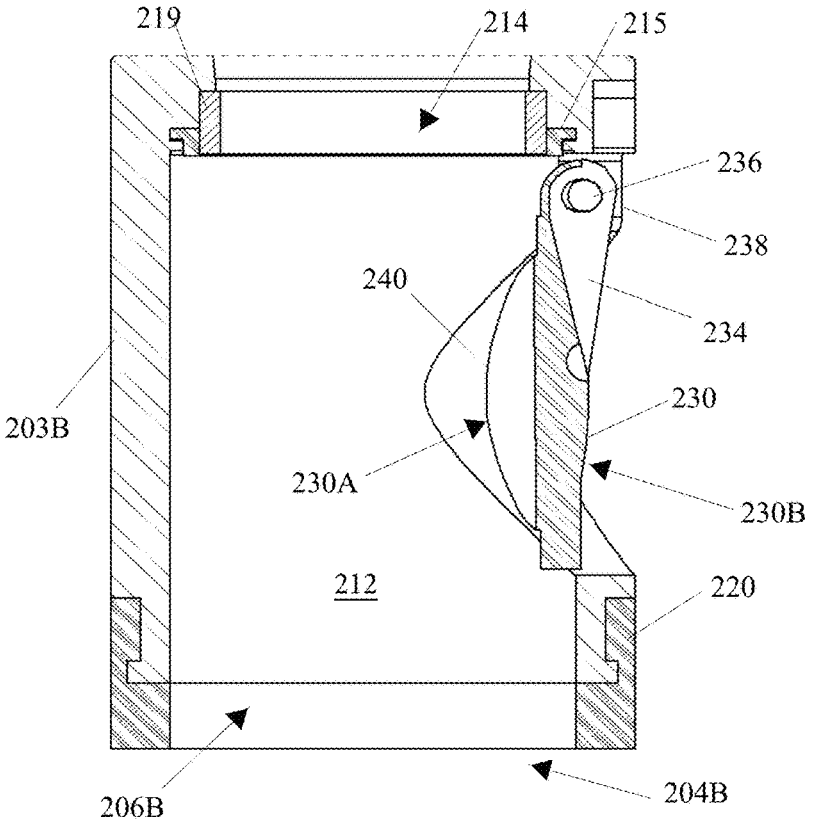
FIGS. 8A-8B are schematic illustrations of the valve chamber of the float valve in open position.
Figure 8B:
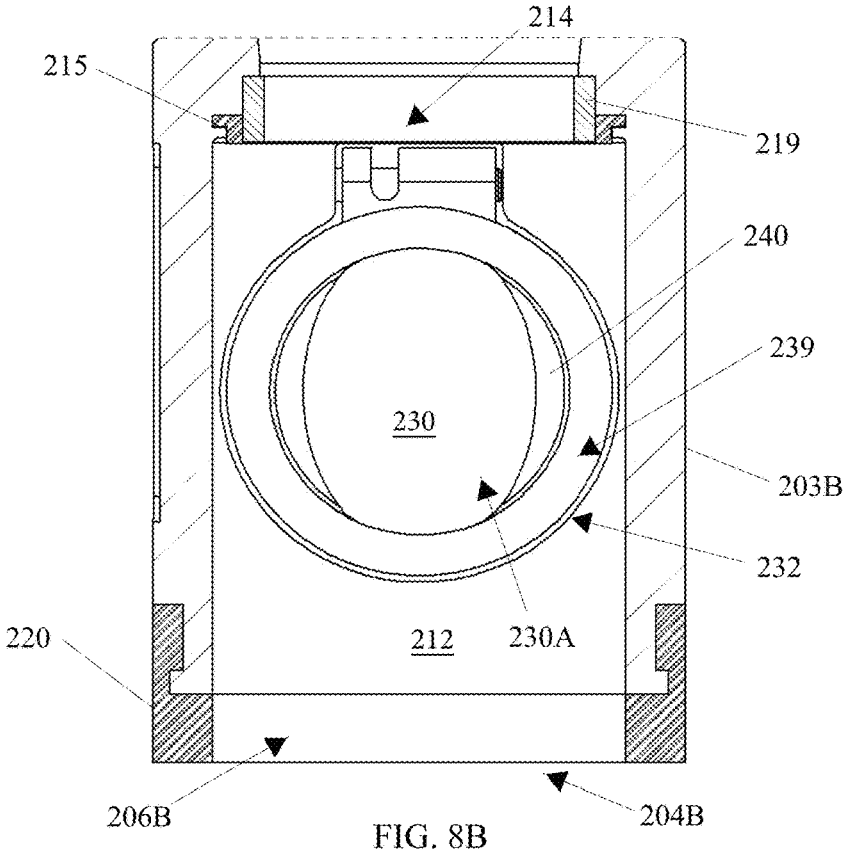

FIGS. 7A-7B illustrate the valve chamber 212, or the lower chamber 212, in side cross sectional views taken along the float valve axis (axis-b shown in FIG. 2C) showing the valve member 230 in the closed position sealing the valve opening 214. FIGS. 8A-8B illustrate the valve chamber 212, or the lower chamber 212, in side cross sectional views taken along the float valve axis (axis-b shown in FIG. 2C) showing the valve member 230 in the open position being retained in the valve member port 232.

Figure 9:
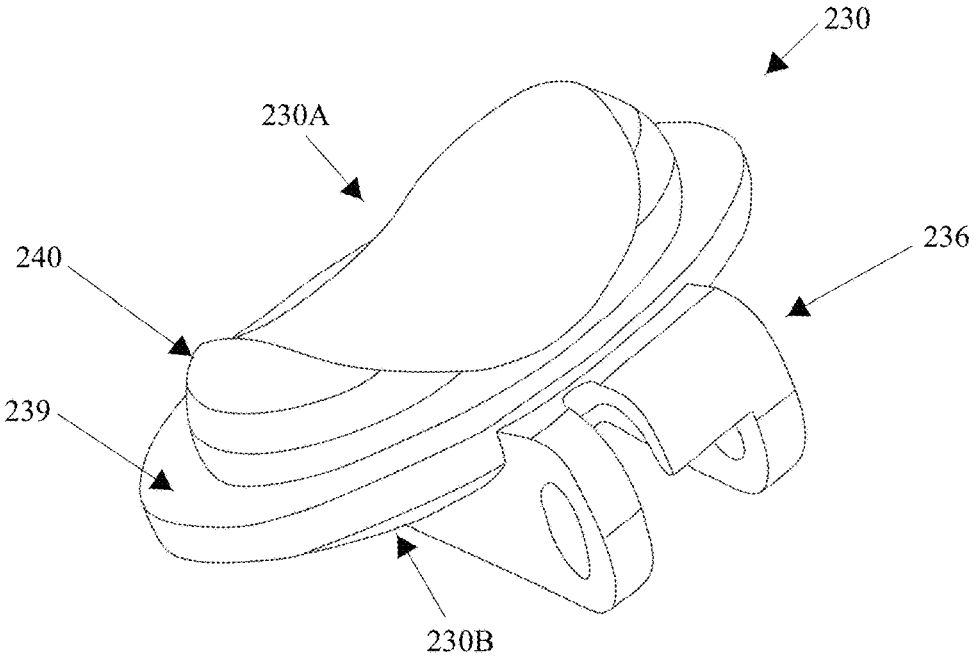
FIG. 9 is a schematic illustration of a valve member of the float valve.
Figure 10:
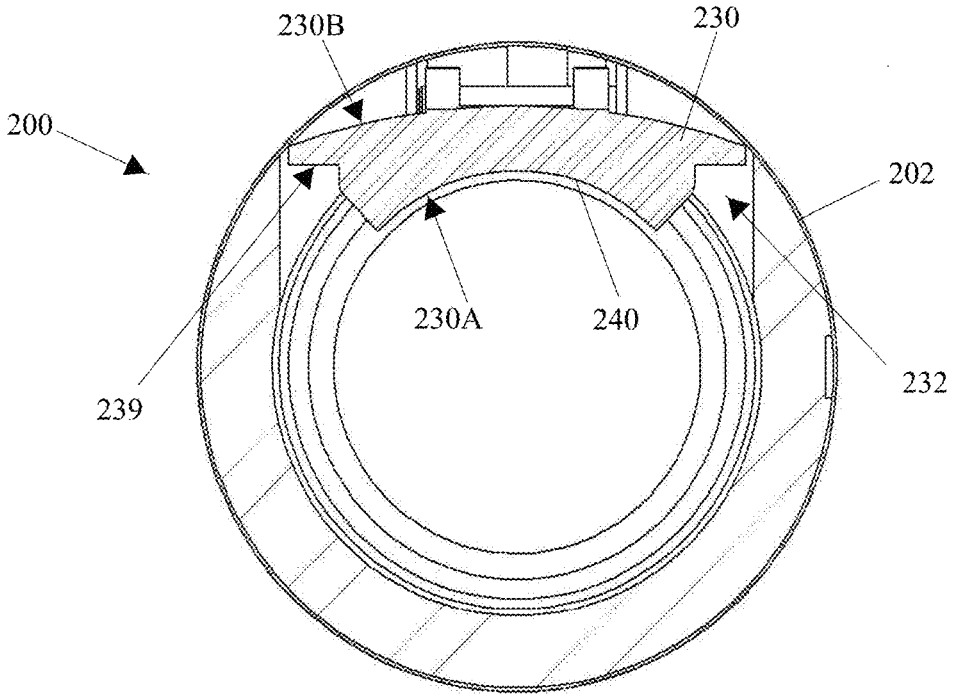
FIG. 10 is a schematic cross section of the float valve including the valve member, in plan view.

Referring to FIGS. 9-10, the valve member 230 of the float valve 200 may include a front side 230A and back side 230B. The front side 230A may include a flat sealing lip 239 surrounding a centering feature 240 protruding from the plane of the of the sealing lip 239 and having a curved surface complying with the curved inner surface of the valve chamber 212. The back side 230B of the valve member 230 is a curved surface complying with the curvature of the outer surface of the valve chamber 212. As also shown in FIGS. 7A-7B, when the valve member 230 is biased to the closed position, the lip 230 of valve member is pressed against the valve opening seal 215 of the valve opening 214 to tightly seal the valve opening 214 while the centering feature 240 securely centers the valve member 230 in the valve opening 214 or self-aligns it in the valve opening. The curved surface of the centering feature 240 may enable ball dropping through the float valve to, for example, activate devices in the lower end of the BHA, or to extend various devices to the lower end of the BHA.

FIGS. 11 and 12 show the various dimensions used in the above description of the valve housing 100 and the float valve 200, respectively.

FIGS. 13A and 13B show the various exemplary values of the various dimensions used in the above description of the valve housing 100 and the float valve 200, respectively.

The present invention provides a downhole valve apparatus including a tubular valve housing including a float valve for well control that may be designed to be installed as a box up connection in the BHA. The float valve allows for fluids to be pumped to the drill bit but blocks any fluid from flowing into the drill pipe in case of a downhole pressure event in the well. The present invention may be designed for box up installation, and with the use of fatigue resistant connection boreback feature, i.e., a stress relief bore. The placement of the annular body seals on the float valve's surface is optimum for the current practices to prevent sealing failures leading to dangerous loss of well control.

The one way float valve prevents reverse flow when the pumps are turned off or a sudden rise in wellbore pressure occurs. The float valve is installed within the valve housing with radial seals that prevent fluid from bypassing the float valve. The seals are positioned up hole of the valve member (flapper) sealing location of the one way valve. The seals may be located as close to the bottom of the float valve as possible. The location of the seals also allows the axial fitment of the float valve to be more precise and thus reduce seal and housing wear.

The stress relief bore feature may improve the flexibility of the connection and thus the BHA reliability by allowing the stress relief bore feature to reduce fatigue failure in the drill string and BHA. The invention will also allow the use of ball activated devices below the float valve. The present invention advantageously minimizes the chances of a catastrophic blowout due to leaking seals and reduces turbulence induced erosion in the housing which increases the life of the housing by preventing seal leakage.

Although aspects and advantages of the present invention are described herein with respect to certain embodiments, modifications of the embodiments will be apparent to those skilled in the art. Thus, the scope of the present invention should not be limited to the foregoing discussions but should be defined by the appended claims.

What is claimed is:

1. A downhole valve apparatus for controlling fluid flow in a string of tubing in drilling operations of a wellbore, comprising:

a tubular housing for connection within a bottom hole assembly in the string of tubing, when connected to an upper tubular housing of the string of tubing a top female end of the tubular housing receives a male end of the upper tubular housing in a joint region;

a valve bore of a first diameter in the tubular housing that communicates with a stress relief bore of a second diameter of the tubular housing, the second diameter being greater than the first diameter;

a valve housed within the valve bore and partially within the stress relief bore being axially movable relative to the tubular housing while in a sealing relationship with the valve bore between a first configuration and a second configuration of the downhole valve apparatus;

a valve member of the valve allows a downward flow of a first fluid having a first pressure delivered to the stress relief bore to flow through the valve in the first configuration, and the valve member blocks an upward flow of a second fluid of a second pressure toward the stress relief bore through the valve in the second configuration; and the valve is adapted that in the second configuration the upward flow of the second fluid axially moves the valve upward within both the stress relief bore and the valve bore of the tubular housing, and in the first configuration the downward flow of the first fluid to the stress relief bore axially moves the valve downward within both the stress relief bore and the valve bore, wherein at least one radial seal on the valve seals an annular space between the valve and the valve bore so that no second fluid flows upwardly through the annular space in the second configuration.

2. The downhole apparatus of claim 1, wherein the stress relief bore axially extends between a top opening of the valve bore of the tubular housing and a lower end of the joint region.

3. The downhole apparatus of claim 2, wherein a clearance gap exists in the stress relief bore between a top end of the valve and the male end of the upper tubular housing at the joint region in the first configuration to avoid any damage to the valve if the stress relief bore being exposed to bending forces during a drilling operation.

4. The downhole apparatus of claim 3, wherein the upward flow of the second fluid axially moves the top end of the valve into the clearance gap to contact with the male end of the upper tubular housing at the joint region, wherein the upward flow of the second fluid occurs either when the flow of the first fluid is stopped or when the pressure of the second fluid overcomes the pressure of the first fluid.

5. The downhole apparatus of claim 4, wherein the top end of the valve is in contact with the male end of the upper tubular housing at the joint region in the second configuration.

6. The downhole apparatus of claim 1, wherein the valve is a float valve including a tubular valve body having an upper valve chamber separated from a lower valve chamber with a valve opening, the valve member being configured to pivotally move between an open position in the first configuration to open the valve opening and a closed position to close the valve opening in the second configuration.

7. The downhole apparatus of claim 6, wherein an inner surface of a side wall defining the upper valve chamber includes a truncated cone shape surface so that the thickness of the side wall of the upper valve chamber uniformly increases from a top opening of the tubular valve body to the valve opening.

8. The downhole apparatus of claim 7, wherein the at least one radial seal is retained in at least one radial seal groove formed in an outer surface of the side wall of the upper valve chamber and the proximity of the valve opening to seal the annular space between an outer surface of the valve and a surface of the valve bore by constantly staying in contact with the surface of the valve bore in the second configuration.

9. The downhole apparatus of claim 8, wherein there is a predetermined safety distance between a top opening of the valve bore and the location of the at least one radial seal on the valve so as not to expose the at least one radial seal to the stress relief bore in the second configuration.

10. The downhole apparatus of claim 6, wherein a side wall of the lower valve chamber includes a valve member port to retain the valve member when in the open position in the first configuration, wherein both curvature of a top surface and curvature of a bottom surface of valve member conform with the curvature of the side wall of the lower valve chamber so as not to disturb the flow of the first fluid.

11. The downhole apparatus of claim 1, wherein the first fluid is a drilling fluid pumped down into the string of tubing and the second fluid is a reverse fluid flowing from the wellbore.

12. The downhole apparatus of claim 1, wherein the at least one radial seal is made of an elastomeric material.

13. The downhole apparatus of claim 6, wherein a bottom end of the tubular valve body includes a shock absorber ring to protect the valve in the first configuration.

14. A method of controlling fluid flow in a string of tubing in drilling operations, comprising:

providing a downhole valve apparatus having a tubular housing for connection within a bottom hole assembly in the string of tubing, when connected to an upper tubular housing of the string of tubing a top female end of the tubular housing receives a male end of the upper tubular housing in a joint region, the tubular housing including a valve bore of a first diameter communicating with a stress relief bore of a second diameter which is greater than the first diameter, the stress relief bore axially extending between a top opening of the valve bore of the tubular housing and a lower end of the joint region, wherein a float valve, including a valve member, is located within the valve bore of the tubular housing and partially within the stress relief bore, the float valve being axially movable relative to the tubular housing between a first configuration and a second configuration of the downhole valve apparatus;

sealing an annular space between the float valve and the valve bore with at least one radial seal on the float valve;

deploying the string of tubing including the downhole valve apparatus in a wellbore for a drilling operation and commencing the drilling operation;

exposing the downhole valve apparatus to a first fluid, wherein the valve member allows a downward flow of the first fluid delivered to the stress relief bore, to flow through the float valve in the first configuration, wherein the downward flow of the first fluid to the stress relief bore axially moves the float valve downward within both the stress relief bore and the valve bore; and exposing the downhole valve apparatus to a second fluid, wherein the valve member blocks an upward flow of the second fluid toward the stress relief bore through the float valve in the second configuration and the upward flow of the second fluid axially moves the float valve upward within both the stress relief bore and the valve bore of the tubular housing, wherein sealing the annular space between the float valve and the valve bore prevents the second fluid from flowing into the stress relief bore through the annular space between the valve bore and the float valve in the second configuration.

15. The method of claim 14, wherein in the step of exposing the downhole valve apparatus to the first fluid, a clearance gap forms in the stress relief bore between a top end of the float valve and the male end of the upper tubular housing at the joint region in the first configuration to avoid any damage to the float valve if the stress relief bore being exposed to bending forces during a drilling operation, wherein the clearance gap forms either by the downward axial movement of the float valve caused by the pressure of the first fluid or placement of the float valve in the tubular housing prior to the commencement of the drilling operation.

16. The method of claim 15, wherein in the step of exposing the downhole valve apparatus to the second fluid, the upward flow of the second fluid axially moves the top end of the valve into the clearance gap to contact with the male end of the upper tubular housing at the joint region in the second configuration, wherein the upward flow of the second fluid occurs either when the flow of first fluid is stopped or when the pressure of the second fluid overcomes the pressure of the first fluid.

17. The method of claim 14, wherein the float valve includes a tubular valve body having an upper chamber separated from a lower chamber with a valve opening, the valve member being configured to pivotally move between an open position in the first configuration to open the valve opening when exposed to the flow of first fluid and a closed position to close the valve opening when exposed to the flow of the second fluid in the second configuration.

18. The method of claim 17, wherein an inner surface of a side wall defining the upper chamber has a truncated cone shape surface so that the thickness of the side wall of the upper chamber uniformly increases from a top opening of the valve body to the valve opening.

19. The method of claim 18, wherein the at least one radial seal is retained in at least one radial seal groove formed in an outer surface of the side wall of the upper chamber and the proximity of the valve opening to seal the annular space between an outer surface of the float valve and a surface of the valve bore by constantly staying in contact with the surface of the valve bore in the second configuration.

20. The method of claim 17, wherein a side wall of the lower chamber of the float valve includes a valve member port to retain the valve member when in the open position in the first configuration, wherein curvature of a top surface and curvature of a bottom surface of the valve member conform with the curvature of the side wall of the lower chamber so as not to disturb the flow of the first fluid.

* * * * *